US010214008B2

(12) United States Patent
Jeapes

(10) Patent No.: US 10,214,008 B2
(45) Date of Patent: Feb. 26, 2019

(54) CIRCUIT FOR DRIVING PRINTER ACTUATING ELEMENTS

(71) Applicant: Xaar Technology Limited, Cambridge (GB)

(72) Inventor: Stephen Mark Jeapes, Southsea (GB)

(73) Assignee: Xaar Technology Limited, Cambridge (GB)

( * ) Notice: Subject to any disclaimer, the term of this patent is extended or adjusted under 35 U.S.C. 154(b) by 0 days.

(21) Appl. No.: 15/579,586

(22) PCT Filed: Jun. 3, 2016

(86) PCT No.: PCT/GB2016/051648

§ 371 (c)(1),
(2) Date: Dec. 4, 2017

(87) PCT Pub. No.: WO2016/193752

PCT Pub. Date: Dec. 8, 2016

(65) Prior Publication Data

US 2018/0170036 A1 Jun. 21, 2018

(30) Foreign Application Priority Data

Jun. 5, 2015 (GB) ..... 1509816.3

(51) Int. Cl.
*B41J 2/045* (2006.01)

(52) U.S. Cl.
CPC ..... *B41J 2/04541* (2013.01); *B41J 2/0459* (2013.01); *B41J 2/04506* (2013.01);
(Continued)

(58) Field of Classification Search
CPC ..... B41J 2/04506; B41J 2/04508; B41J 2/04525; B41J 2/04541; B41J 2/04543;
(Continued)

(56) References Cited

U.S. PATENT DOCUMENTS 5,049,898 A * 9/1991 Arthur ..... B41J 2/17546 346/139 C
5,997,124 A 12/1999 Capps et al.
(Continued)

FOREIGN PATENT DOCUMENTS

EP 1 241 006 A2 9/2002
EP 2 450 192 A1 5/2012
(Continued)

OTHER PUBLICATIONS

PCT International Search Report and Written Opinion; PCT/GB2016/051648; dated Aug. 11, 2016.
(Continued)

*Primary Examiner* — Anh T. N. Vo
(74) *Attorney, Agent, or Firm* — Finnegan, Henderson, Farabow, Garrett & Dunner LLP

(57) ABSTRACT

A circuit for driving first and second groups of actuating elements for ejection of droplets from a printhead, the circuit comprising: a drive circuit configured to provide a drive waveform to first electrodes of the first and second groups; and a voltage offset circuit configured to provide a voltage offset to the second electrodes of the first or second groups to bias the second electrodes of the first and second groups relative to each other.

19 Claims, 18 Drawing Sheets

(52) U.S. Cl.
CPC ..... *B41J 2/04525* (2013.01); *B41J 2/04543* (2013.01); *B41J 2/04568* (2013.01); *B41J 2/04573* (2013.01); *B41J 2/04581* (2013.01); *B41J 2/04586* (2013.01); *B41J 2/04588* (2013.01); *B41J 2202/13* (2013.01)

(58) Field of Classification Search
CPC ..... B41J 2/04568; B41J 2/04573; B41J 2/04581; B41J 2/04586; B41J 2/04588; B41J 2/0459; B41J 2202/13
See application file for complete search history.

(56) References Cited

U.S. PATENT DOCUMENTS 6,132,021 A * 10/2000 Smith ..... B41J 2/2114 347/101
6,799,821 B1 * 10/2004 Okuda ..... B41J 2/04581 347/10
2003/0202024 A1 * 10/2003 Corrigan ..... B41J 2/04506 347/9
2005/0062804 A1 * 3/2005 Eaton ..... B41J 2/04541 347/57
2006/0023010 A1 2/2006 Kobayashi et al.
2008/0100649 A1 5/2008 Matsui et al.
2014/0210884 A1 7/2014 Rosario et al.

FOREIGN PATENT DOCUMENTS

JP H 10-235863 A 9/1998
WO 2009-142897 A1 11/2009

OTHER PUBLICATIONS

UKIPO Search and Examination Report; GB 1509816.3; dated Dec. 7, 2015.

* cited by examiner

10 CIRCUIT
20 DRIVE CIRCUIT
30 VOLTAGE OFFSET CIRCUIT FOR COMPENSATING FOR NON-UNIFORMITY
DRIVE WAVEFORM
ACTUATING ELEMENT 1
ACTUATING ELEMENT 2
DRIVE WAVEFORM WITH TIME OFFSET
VOLTAGE OFFSET FOR SECOND ELECTRODES OF FIRST GROUP
VOLTAGE OFFSET FOR SECOND ELECTRODES OF SECOND GROUP
ACTUATING ELEMENT 1A
ACTUATING ELEMENT 2A

10 CIRCUIT
20 DRIVE CIRCUIT
DRIVE WAVEFORM
ACTUATING ELEMENT 1
ACTUATING ELEMENT 2
DRIVE WAVEFORM WITH TIME OFFSET
30 VOLTAGE OFFSET CIRCUIT
VOLTAGE OFFSET FOR SECOND ELECTRODES OF FIRST GROUP
VOLTAGE OFFSET FOR SECOND ELECTRODES OF SECOND GROUP
PRINT IMAGE CHARACTERISTIC
ACTUATING ELEMENT 1A
37 PROCESSING CIRCUIT
ACTUATING ELEMENT 2A
PRINT IMAGE DATA

CIRCUIT FOR DRIVING PRINTER ACTUATING ELEMENTS

CROSS-REFERENCE TO RELATED APPLICATIONS

This application is a US national phase of PCT/GB2016/051648, filed 3 Jun. 2016 and titled CIRCUIT FOR DRIVING PRINTER ACTUATING ELEMENTS, which claims priority to United Kingdom Patent Application No. GB 1509816.3, filed 5 Jun. 2015 and titled CIRCUIT FOR DRIVING PRINTER ACTUATING ELEMENTS WITH OFFSETS, the entire disclosures of which are herein incorporated by reference.

The present invention relates to circuits for printheads for driving actuating elements, to printheads having such actuating elements and circuits, and to methods of configuring such circuits in printheads.

It is known to provide printhead circuits for printers such as inkjet printers. For example, the inkjet industry has been working on how to drive printheads with piezoelectric actuating elements for more than thirty years. Multiple drive methods have been produced and there are many different types in use today, some are briefly discussed below.

Hot Switch: This is a class of driving methods that keep the demux (demultiplex) function and the power dissipation (CV^2) in the same driver IC (Integrated Circuit). This was the original drive method, before cold switch became popular.

Rectangular Hot Switch: This describes hot switch systems that have no flexible control over rise and fall time and only two voltages (0V and 30V for example). In some cases, waveform delivery is uniform to all the actuating elements. The waveform has some level of programmability. DAC Hot Switch describes a class of drive options that has a logic driving an arbitrary digital value stream to a DAC (digital to analog converter) per actuating element, outputs a high voltage drive power waveform scaled from this digital stream. In terms of driving flexibility, this option has the most capability. It is limited only by the number of digital gates and the complexity that system designers can use and/or tolerate.

Cold Switch Demux: This describes an arrangement in which all actuating elements are fed the same drive signal through a pass gate type demultiplexer. The drive signal can be gated at sub-pixel speeds.

It is also known to provide some factory calibration to take account of variations in the performance of droplets ejected from adjacent actuating chambers in the same array, and to compensate for these variations by trimming the drive signals applied to the individual actuating elements of the array. It is also known that adjacent actuating chambers in an array may suffer from fluidic and/or mechanical crosstalk when driven at or near the same time, and that some compensation for such crosstalk is possible by providing a suitable time offset between the drive waveforms applied to such adjacent actuating chambers. However, these compensation strategies may interfere with each other and thus may not provide the adjustment required to overcome the manufacturing variations/crosstalk effects. Furthermore, it is difficult to compensate for variations in performance between actuating elements in different arrays on the same or on different actuating element dies. One solution may be to provide multiple waveforms to the different actuating element dies, but such a configuration also requires individual nozzle trimming, which increases complexity and may reduce printhead performance due to, for example, the large amounts of information required to be generated, and processed at the printhead, in order to achieve the desired effect.

According to a first aspect there is provided a circuit for driving first and second groups of actuating elements for ejection of droplets from a printhead, the circuit comprising: a drive circuit configured to provide a drive waveform to first electrodes of the first and second groups; and a voltage offset circuit configured to provide a voltage offset to the second electrodes of the first or second groups to bias the second electrodes of the first and second groups relative to each other.

Preferably, the drive circuit is configured to provide a time offset between the drive waveform applied to different sets of actuating elements so as to temporally offset corresponding transitions of the respective drive waveforms.

Preferably, the voltage offset being suitable to compensate for a non-uniformity in droplet ejection between the first and second groups of actuating elements.

Preferably, the circuit having an offset adjustment circuit configured to adjust the voltage offset, and wherein the offset adjustment circuit having a fixed circuit to generate a fixed component of the voltage offset and the voltage offset circuit being arranged to combine the fixed component with an adjustable voltage offset provided by the offset adjustment circuit.

Preferably, the drive circuit being configured to provide at least two common drive waveforms, offset in time from each other, each for driving a set of actuating elements, and the drive circuit comprising one or more switches, each switch being configured for selectively coupling one of the common drive waveforms to a respective group, the drive circuit having a controller for controlling the switches according to a print signal.

Preferably, the circuit having a processing circuit configured to generate a print image characteristic, and the voltage offset circuit being arranged to generate the voltage offset according to the print image characteristic, and the print image characteristic comprising any of: a number of active pixels, a spatial profile, a temporal profile or any combination of these.

In a further aspect there is provided a printhead comprising one or more actuating element dies each actuating element die having a plurality of actuating elements for the ejection of droplets provided in one or more arrays thereon, wherein first electrodes of the actuating elements are coupled to a drive circuit and wherein second electrodes of the actuating elements are coupled to the voltage offset circuit of the circuit.

Preferably, an array of the one or more arrays is a linear array and wherein the one or more actuating element dies each comprise one or more groups of actuating elements. Preferably, each of the one or more actuating element dies comprise at least one group of actuating elements.

Preferably, each of the one or more arrays comprise actuating elements in at least one group.

In a further aspect there is provided a method of configuring a printhead, the method comprising: determining a non-uniformity in performance between first and second groups of actuating elements of the printhead; determining a group compensation amount for the first group of the actuating elements to compensate for the non-uniformity; determining a voltage offset to provide the group compensation amount; configuring the voltage offset circuit to generate the voltage offset; providing the voltage offset to the first group and/or the second group.

According to a further aspect of the invention, there is provided a circuit for a printhead for driving actuating elements for the ejection of droplets and having: a drive circuit for providing drive waveforms for driving respective first electrodes of the actuating elements, with a time offset between the drive waveforms applied to different ones of the actuating elements so as to temporally offset corresponding transitions in their respective drive waveforms, and a voltage offset circuit for generating a voltage offset for coupling to respective second electrodes of a group of the actuating elements, to provide a voltage offset of the drive waveforms for the group of actuating elements relative to the drive waveforms of others of the actuating elements. It will be understood that the voltage offset may be a voltage offset from a common voltage or separate voltages (with respect to ground).

By applying the voltage offset to one electrode of at least two electrodes required to drive the actuating element, and applying the time offset to interleave waveforms to the at least one other electrode of the actuating elements, both types of offsets, temporal and voltage, can be combined efficiently. This means the voltage offset can thus be applied to a group of actuating elements independently of how the temporal offsets are interleaved and grouped, which can overcome the above mentioned contradictory nature of the two types of offsets without the complexity and cost involved otherwise in controlling each actuating element individually, and in calibrating such control. Another benefit is that the technique is compatible with and can complement individual actuating element trimming by reducing the required range of adjustment from the individual actuating element trimming. Note the benefits can apply whether the voltage offset is to compensate for differences or to apply a background image for any reason (e.g. to apply a watermark or to filter the image in any way for example). The benefits can apply regardless of how the drive waveform is generated (e.g. hot switch or cold switch), and regardless of whether the voltage offset is fixed or adjustable. A hot switch system could potentially lower the cost of the driver IC by using this technique. For example the driver IC could control pulse width only, and this technique could compensate for low ejected droplet volumes, over the span of actuating elements across the printhead.

Any additional features can be added to any of the aspects, or disclaimed from them, and some such additional features are described and some set out in dependent claims.

One such additional feature is the voltage offset being suitable to compensate for a non-uniformity in droplet ejection between one group of actuating elements and further actuating elements not included in this group. A benefit is improved trade-off between quality of print output and tolerance of component non-uniformity or lower quality of components, and costs for example. Note that the non-uniformity can for example encompass non-uniformity in circuit components, circuit connections, or variations in actuating chambers due to, for example, variations between actuating elements, and can be due to any cause, including for example manufacturing variations, or thermal or mechanical variations. See FIG. 2 for example.

Another such additional feature is an offset adjustment circuit for adjusting the voltage offset. This can enable compensation to be altered after manufacture in the factory, or in the field. See FIG. 3 for example.

Another such additional feature is the voltage adjustment circuit having a fixed circuit to generate a fixed component of the voltage offset and the voltage offset circuit being arranged to combine the fixed component with an adjustable voltage offset provided by the offset adjustment circuit. This can enable the separate circuits to be optimised as desired to reduce costs or provide suitable range or precision of offsets. See FIG. 3 for example.

Another such additional feature is the drive circuit being configured to provide at least two common drive waveforms offset in time from each other, each for driving a set of actuating elements, the sets being interleaved, and the drive circuit comprising a set of switches each switch being configured for selectively coupling one of the common drive waveforms to a respective actuating element, and the drive circuit having a controller for controlling the switches according to a print signal. This combination with so-called cold switching can be beneficial since the provision of a common drive waveform is inherently more difficult to adjust than arrangements having individual amplifiers for driving the actuating elements. See FIG. 4 for example.

Another such additional feature is a processing circuit configured to generate a print image characteristic, and the voltage offset circuit being arranged to generate the voltage offset according to the print image characteristic. This can help in compensating for non-uniformities caused by the image characteristic, or can provide some low resolution filtering for example. See FIG. 5, 8 or 9 for example.

Another such additional feature is the print image characteristic comprising any of: a number of active pixels, a spatial profile, a temporal profile, and any combination of these. These are some particular image characteristics which can cause non-uniformities or can be enhanced.

Another aspect of the invention provides a printhead comprising the actuating elements, coupled to the circuit as set out above, such that the drive circuit is coupled to respective first electrodes of the actuating elements, and the voltage offset circuit is coupled to respective at least second electrodes of the group of the actuating elements. The same benefits apply when the circuit is incorporated in the printhead. See FIG. 1 for example.

Another such additional feature is the group comprising a group of adjacent actuating elements. This enables spatially clustered non-uniformities to be compensated efficiently, or spatially clustered enhancements to be applied.

Another such additional feature is the actuating elements being arranged in at least one array, e.g. a linear array, and the group of adjacent actuating elements comprising a linear array of the actuating elements. This is a common arrangement of actuating elements, and enables linear variations to be compensated for example.

Another aspect of the invention provides a printer having a printhead as set out above. Another aspect of the invention provides a method of configuring a printhead having actuating elements, the method having steps of: determining a non-uniformity between outputs of different ones of the actuating elements, determining a group compensation amount for a group of the actuating elements to compensate for the non-uniformity, determining a voltage offset to provide the group compensation amount, and configuring a voltage offset circuit for generating the voltage offset for applying to respective second electrodes of the group of the actuating elements, to provide a voltage offset of drive waveforms for these actuating elements relative to drive waveforms of others of the actuating elements. See FIG. 6 for example.

Another such additional feature is the method being carried out during manufacturing of the printhead.

Numerous other variations and modifications can be made without departing from the claims of the present invention. Therefore, it should be clearly understood that the form of the present invention is illustrative only and is not intended to limit the scope of the present invention.

How the present invention may be put into effect will now be described by way of example with reference to the appended drawings, in which.

Figures 14A, 14B, 14C, 14D, 14E:
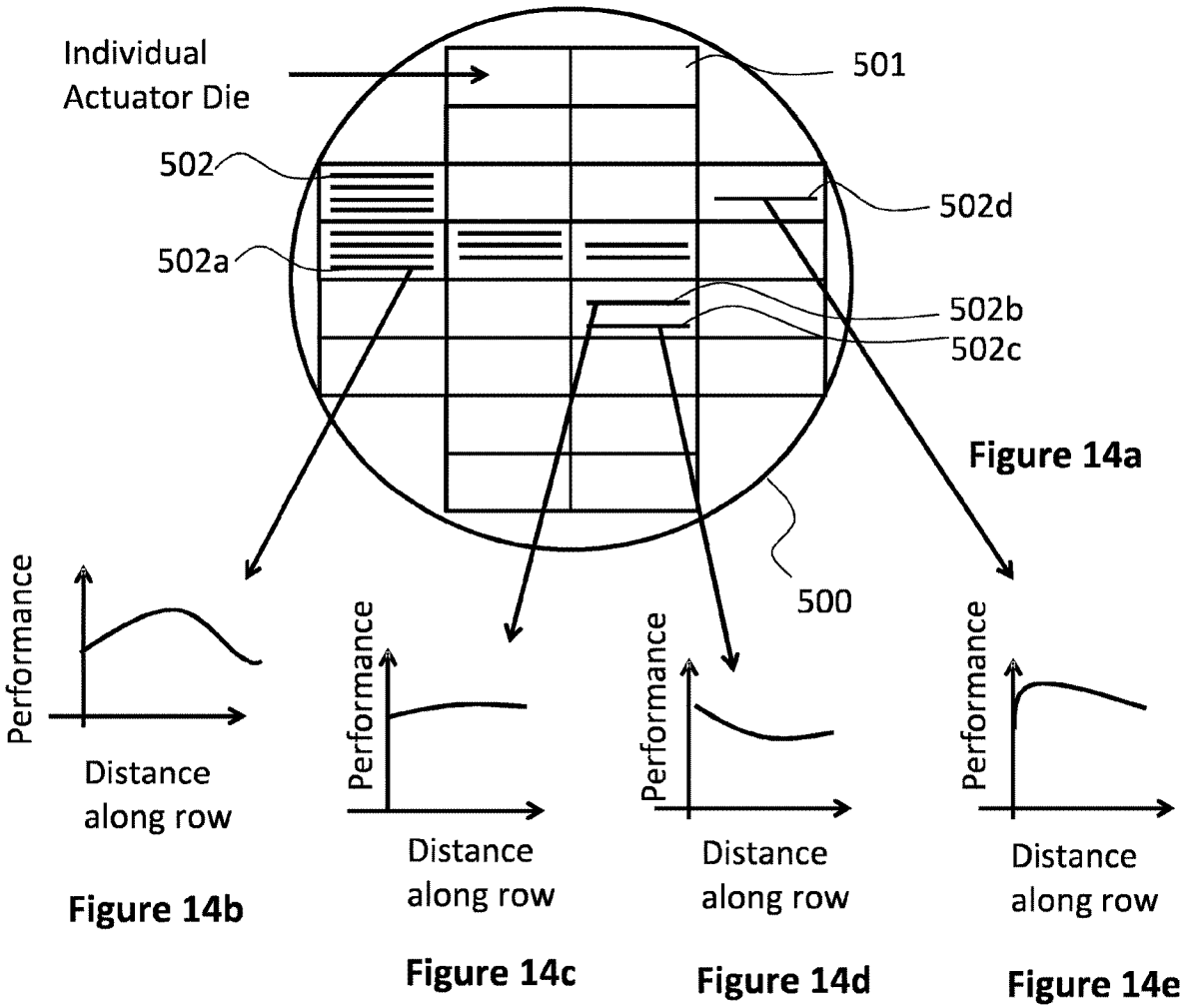

FIG. 14*a*, illustratively shows a wafer comprising a plurality of actuating element dies each having one or more linear arrays thereon according to an embodiment;

FIGS. 14*b*-14*e* show graphs demonstrating variation in performance along a selection of the linear arrays of FIG. 14*a;*

Figure 15A:
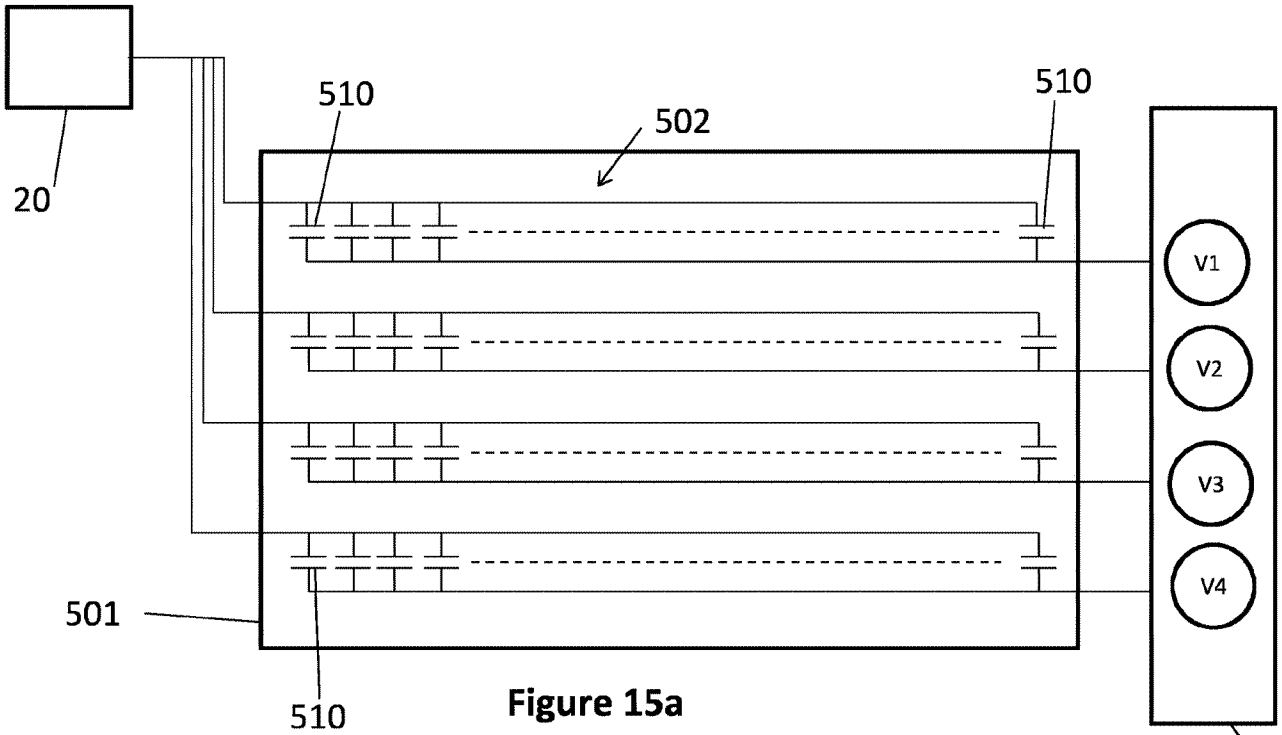
Figure 15B:
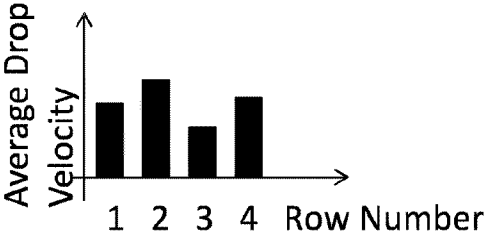
Figure 15C:
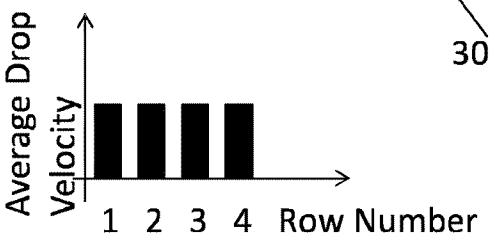

FIG. 15*a* illustratively shows an actuating element die of FIG. 14*a* in greater detail having four arrays of actuating elements provided thereon;

FIGS. 15*b* and 15*c* show graphs of average droplet velocity across the different arrays of actuating elements of FIG. 15*a;*

Figure 16:
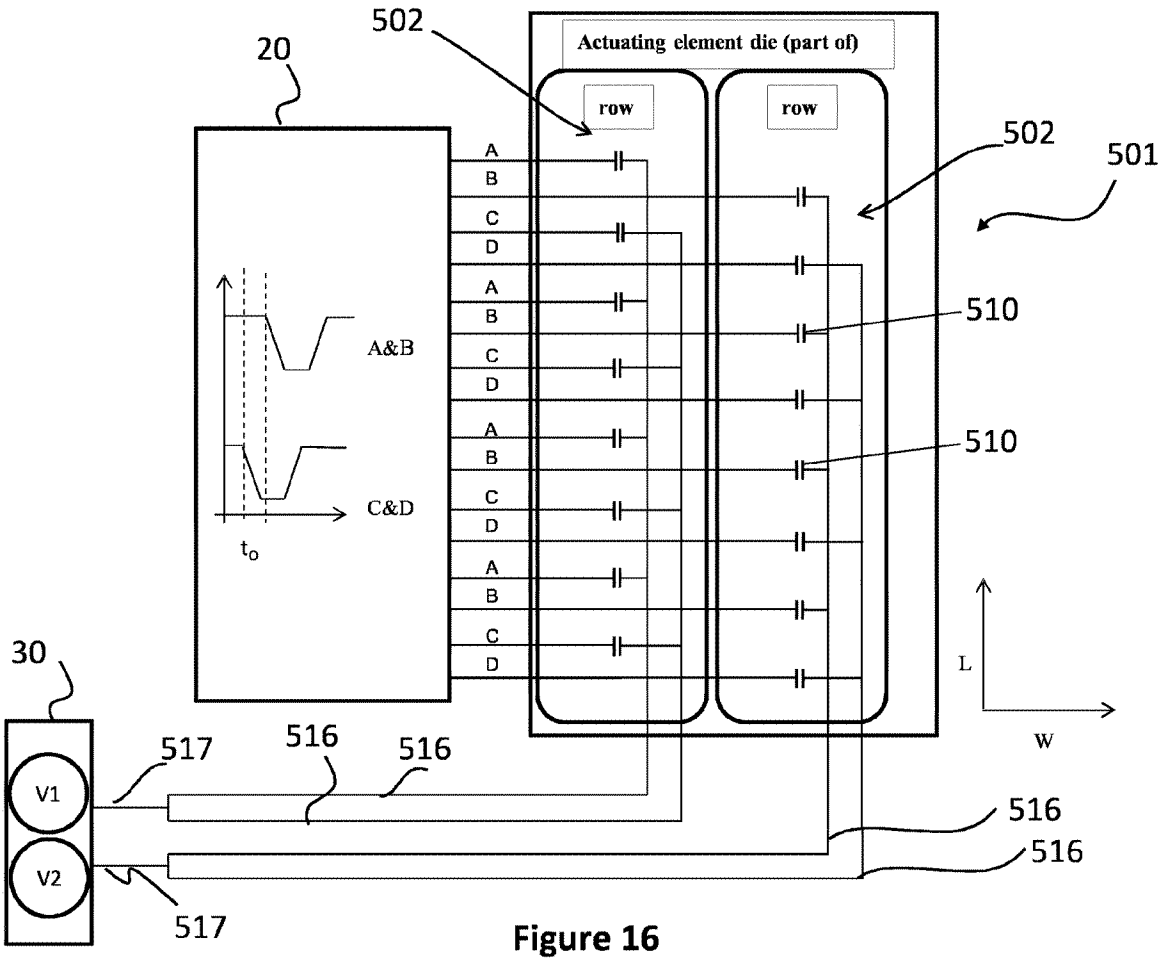
Figure 17A:
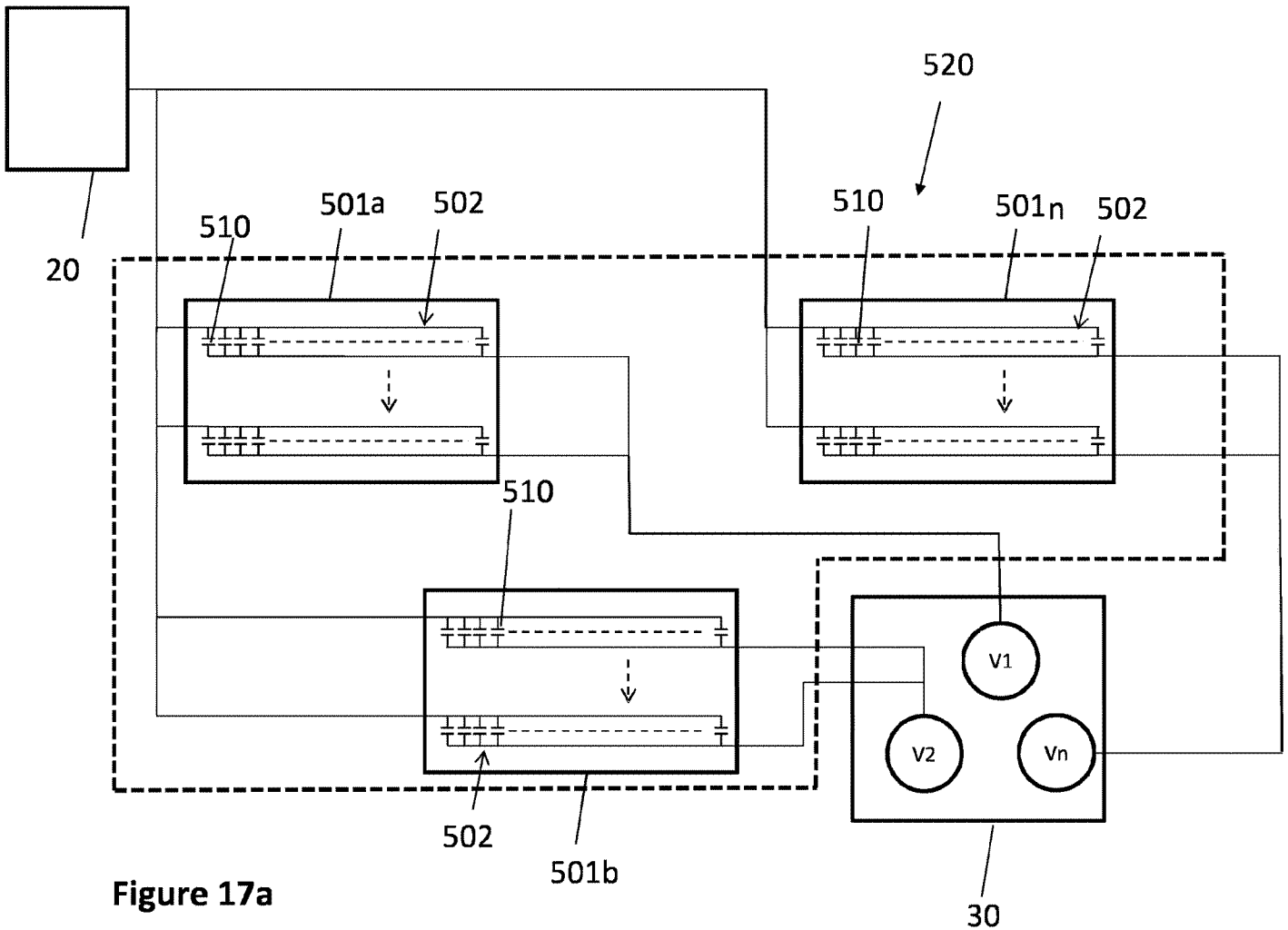
Figure 17B:
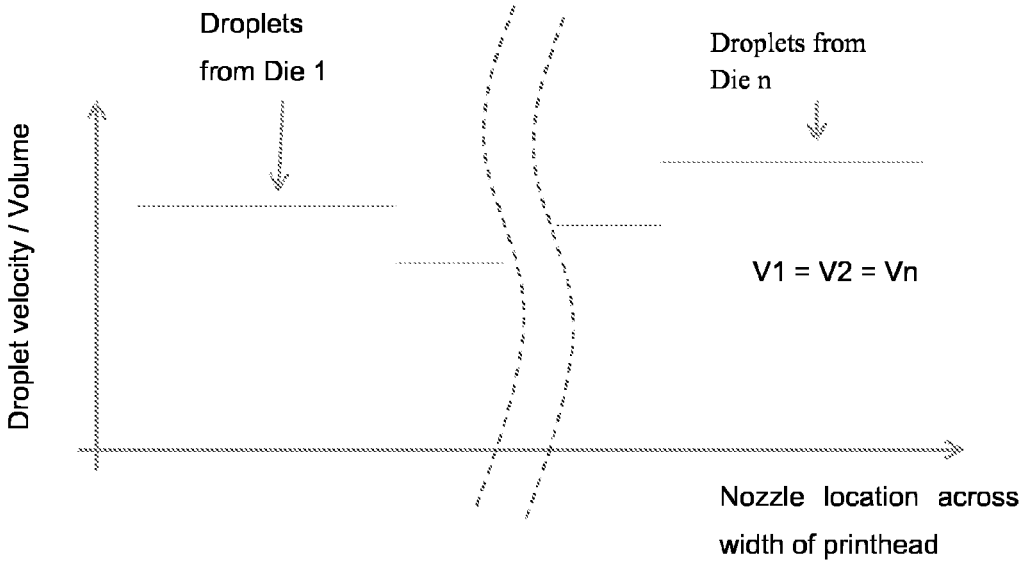
Figure 17C:
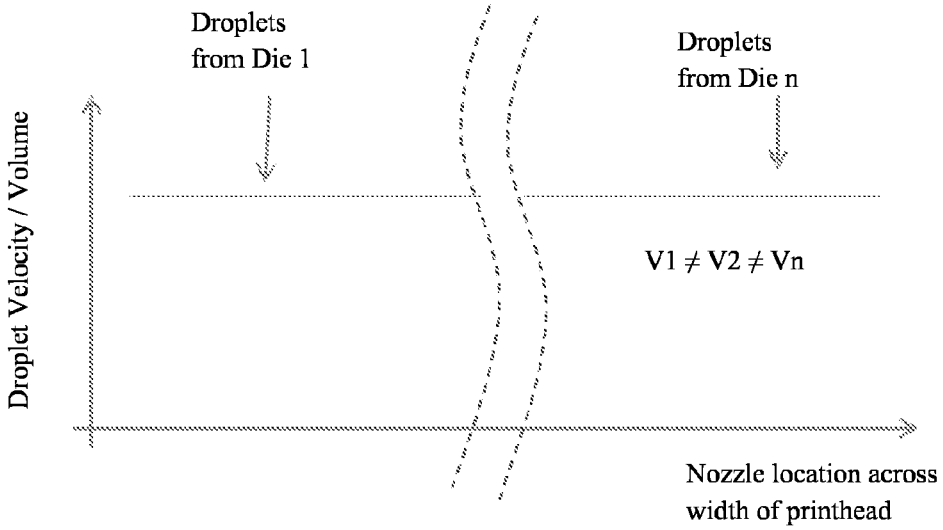
Figure 18:
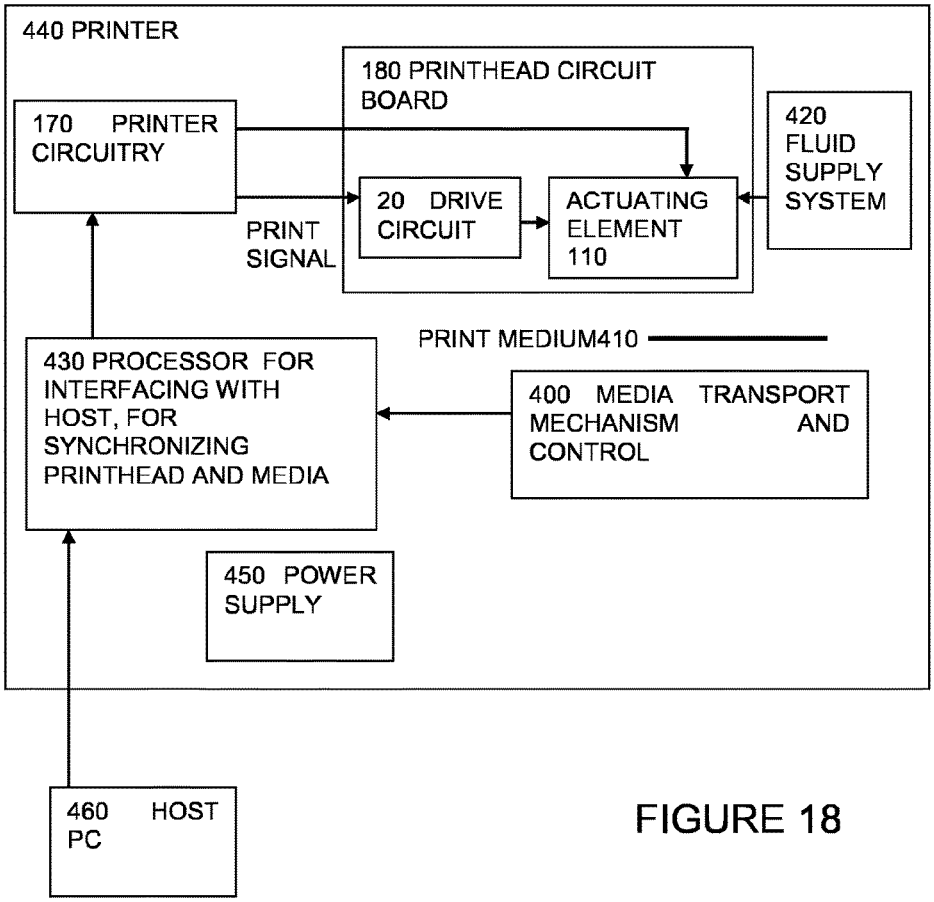

FIG. 16 illustratively shows a portion of an actuating element die according to a further embodiment;

FIG. 17*a* illustratively shows a plurality of actuating element dies according to a further embodiment;

FIGS. 17*b* and 17*c* are graphs of variation in average droplet velocity from different actuating element dies without and with compensation according to an embodiment; and FIG. 18 shows a schematic view of a printer according to an embodiment.

The present invention will be described with respect to particular embodiments and with reference to drawings but note that the invention is not limited to features described, but only by the claims. The drawings described are only schematic and are non-limiting. In the drawings, the size of some of the elements may be exaggerated and not drawn to scale for illustrative purposes.

Where the term "comprising" is used in the present description and claims, it does not exclude other elements or steps and should not be interpreted as being restricted to the means listed thereafter. Where an indefinite or definite article is used when referring to a singular noun e.g. "a" or "an", "the", this includes a plural of that noun unless something else is specifically stated.

References to programs or software can encompass any type of programs in any language executable directly or indirectly on any computer. References to circuit or circuitry or processor or processing circuit or computer are intended to encompass any kind of processing hardware which can be implemented in any kind of logic or analog circuitry, integrated to any degree, and not limited to general purpose processors, digital signal processors, ASICs (Application Specific Integrated Circuits), FPGAs (Field Programmable Gate Arrays), discrete components or logic and so on, and are intended to encompass implementations using multiple processors which may be integrated together, or co-located or distributed at different locations for example.

References to actuating chambers are intended to encompass any kind of actuating chamber comprising one or more actuating elements for effecting the ejection of droplets from at least one nozzle that is associated with the actuating chamber. The actuating chamber may eject any kind of fluid from at least one fluid reservoir for printing 2D images or 3D objects for example, onto any kind of media, the actuating chambers having actuating elements for causing droplet ejection in response to an applied electrical voltage or current, and the actuating chambers representing any type of suitable configuration of the geometry between its actuating element(s) and nozzle(s) to eject droplets, such as for example but not limited to roof mode or shared wall geometry.

References to actuating elements are intended to encompass any kind of actuating element to cause the ejection of droplets from the actuating chamber, including but not limited to piezoelectric actuating elements typically having a predominantly capacitive circuit characteristic or electrothermal actuating elements typically having a predominantly resistive circuit characteristic. Furthermore, the arrangement and/or dimensions of the actuating element are not limited to any particular geometry or design, and in the case of a piezoelectric element may take the form of, for example, thin film, thick film, shared wall, or the like.

References to groups or sets of the actuating elements are intended to encompass linear arrays (e.g. rows) or non-linear arrays of neighbouring actuating elements, or 2-dimensional rectangles or other patterns of neighbouring actuating elements, or any pattern or arrangement, regular or irregular or random, of neighbouring or non-neighbouring actuating elements. References to groups or sets of the actuating elements are also intended to include actuating elements of different rows and of different actuating element dies.

The term "group" is generally used where the respective second electrodes have the same voltage offset, and the term "set" is generally used where the respective first electrodes have the same temporal offset.

To introduce the embodiments described below, some notable features will be discussed. Many existing actuating chambers have actuating elements, each with two or more electrodes, which are often connected such that a first electrode (e.g. a top electrode) is supplied with a drive waveform and a second electrode (e.g. a bottom electrode) is arranged in common connection with (any) other second electrode(s).

The embodiments described are based on a realisation that, while a drive waveform may be supplied to the first electrode for driving the actuating element, rather than connecting the second electrode to a common connection, the second electrode can instead be connected to a voltage source which can provide a voltage offset thereto.

Although offsetting the voltage on the second electrode does not change an amplitude of the waveform directly, because the response of an actuating element containing a piezoelectric material, such as PZT (lead zirconate titanate), may only be linear over a relatively small range of voltages, a 40V to 10V pulse can result in a different droplet velocity in comparison to a 35V to 5V pulse or a 30V to 0V pulse even though the pulse-height remains substantially the same.

This in turn enables different actuating elements in a printhead to be connected together for having different types of offset provided thereto.

As an illustrative example, for the time offset, alternate actuating elements, or every "nth" actuating element, can be connected in a set by connecting first electrodes of respective actuating elements.

Furthermore, the second electrodes can be coupled in different groups, so that a voltage offset can be applied to the respective actuating elements, whereby the groups can be selected independently of how the first electrodes are coupled together. This is one way in which the different types of offset can be implemented more efficiently by means of using the second electrode for the voltage offset rather than using a common return path, or ground, for all the second electrodes.

The connecting together of the second electrodes into groups could be done either on the actuating element using multiple common electrodes or as part of the driver circuitry. Thus the circuitry can be simpler than those which only utilise a single electrode or a single common electrode. This can lead to shorter design/test cycles and a lower cost solution, particularly where there are many actuating elements, sometimes hundreds, thousands or tens of thousands of actuating elements.

Because techniques for both crosstalk mitigation and compensation for actuating element variation can be provided for different groups and sets, and/or implemented together on the same printhead, there is less setup required during manufacturing compared with current techniques which require control of the individual actuating elements.

Figure 1:
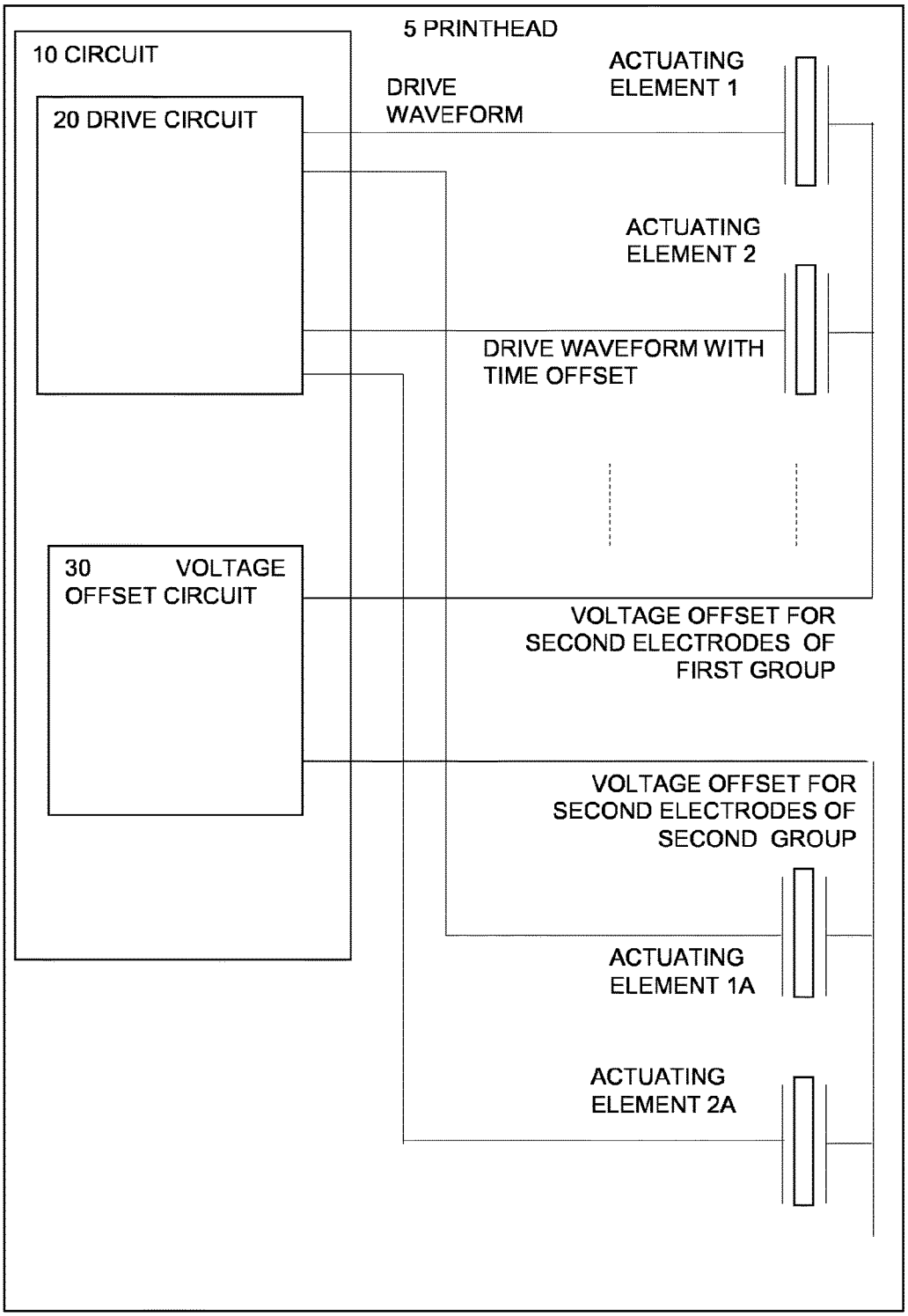
FIG. 1 shows a schematic view of a circuit according to an embodiment, coupled to actuating elements in a printhead.

FIG. 1 shows a schematic view of a printhead 5 having actuating elements 1 and 2, 1A and 2A, and a circuit 10 for driving the actuating elements according to an embodiment. The circuit has a drive circuit 20 for providing drive waveforms to the first electrodes of the actuating elements and a voltage offset circuit 30 for providing the voltage offsets to the second electrodes of the actuating elements. As shown, the drive circuit provides a drive waveform to a first electrode of actuating element 1, and a drive waveform with a time offset to a first electrode of actuating element 2 which is adjacent to actuating element 1. These two actuating elements and others not shown form a first group of actuating elements, having their second electrodes coupled together so as to receive the same voltage offset. A second group of actuating elements are shown including actuating elements 1A and 2A also have their second electrodes coupled together so as to receive the same voltage offset, but this can be a different voltage offset to that received by the first group of actuating elements. In the second group, actuating element 1A has its first electrode driven by a drive waveform from the drive circuit. Adjacent actuating element 2A has its first electrode driven by another drive waveform having a time offset relative to that for actuating element 1A so that corresponding transitions in the drive waveforms are temporally offset, so that they are out of phase, or interleaved for example. The interleaving can be of alternate actuating elements or repeated every third or fourth or "nth" actuating element and so on in principle, depending on how well the cross talk is reduced.

Alternatively, the interleaving can be of actuating elements in different arrays, or even of on different actuating element dies.

The drive circuit 20 can be implemented in various ways and some will be described in more detail below. The voltage offset circuit 30 can be implemented in various ways, and some will be described below.

The voltage offset circuit can be used to reduce or minimise differences in performance between the different groups, or in some cases, the offset can be used to produce enhanced images by filtering or producing image related effects, or watermarking for example.

Figure 2:
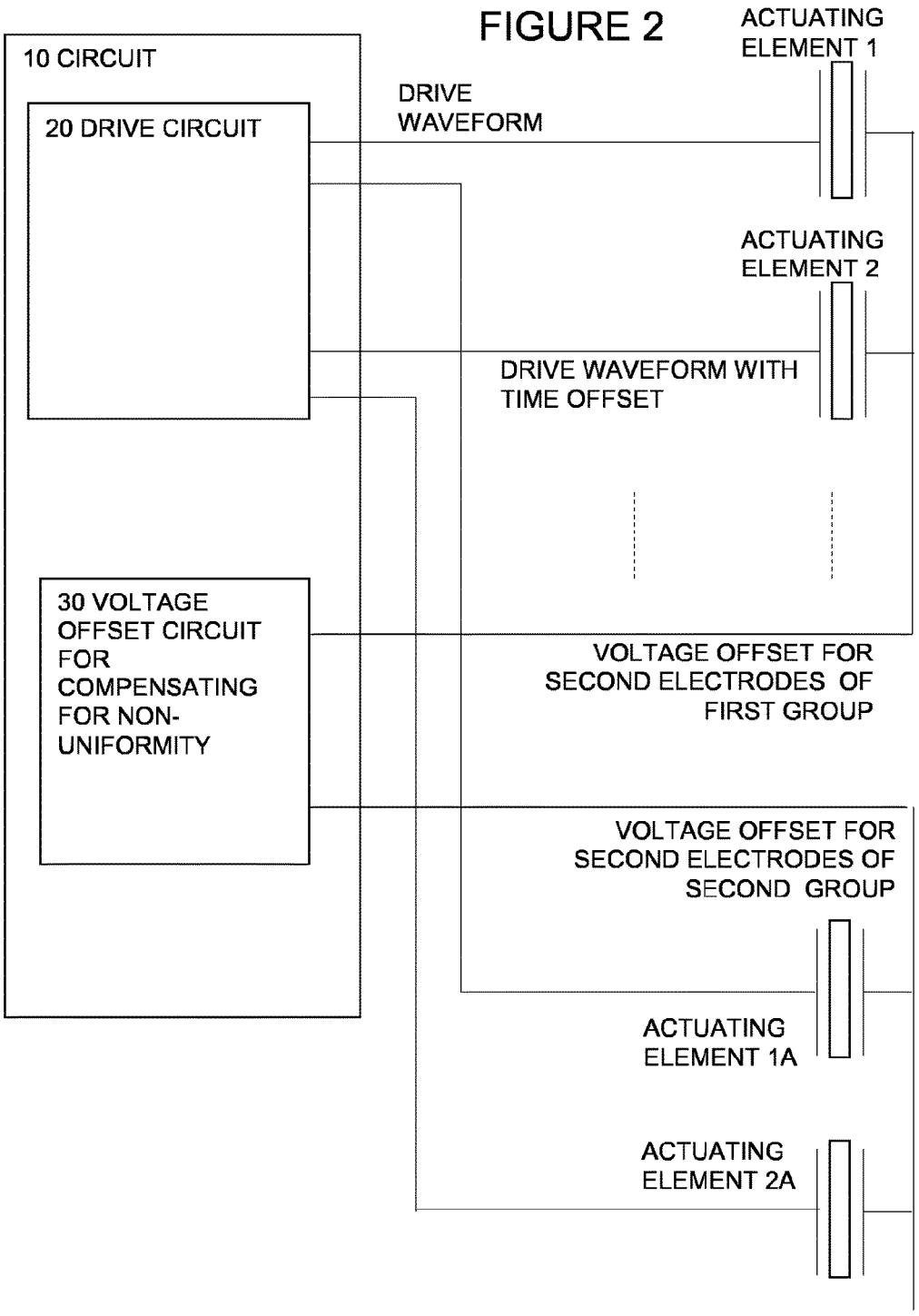
FIGS. 2 and 3 show schematic views of a circuit according to other embodiments.

FIG. 2 shows a schematic view of an embodiment similar to that of FIG. 1 and corresponding reference numerals have been used as appropriate. In FIG. 2 the voltage offset circuit 30 is arranged for compensating for non-uniformity between the different groups of actuating elements. Such non-uniformities may be caused by the manufacture process used to fabricate different components of a printhead (e.g. the actuating elements and/or actuating chambers), or in the circuit components, or in spatial variations in the operating temperature for example, and therefore may be static or dynamic. For the static cases, calibration measurements may be stored in the voltage offset circuit 30, or retrieved from an external store (e.g. memory at the controller). For the dynamic cases, measurements may be received periodically, or calculated or interpolated for example.

Figure 3:
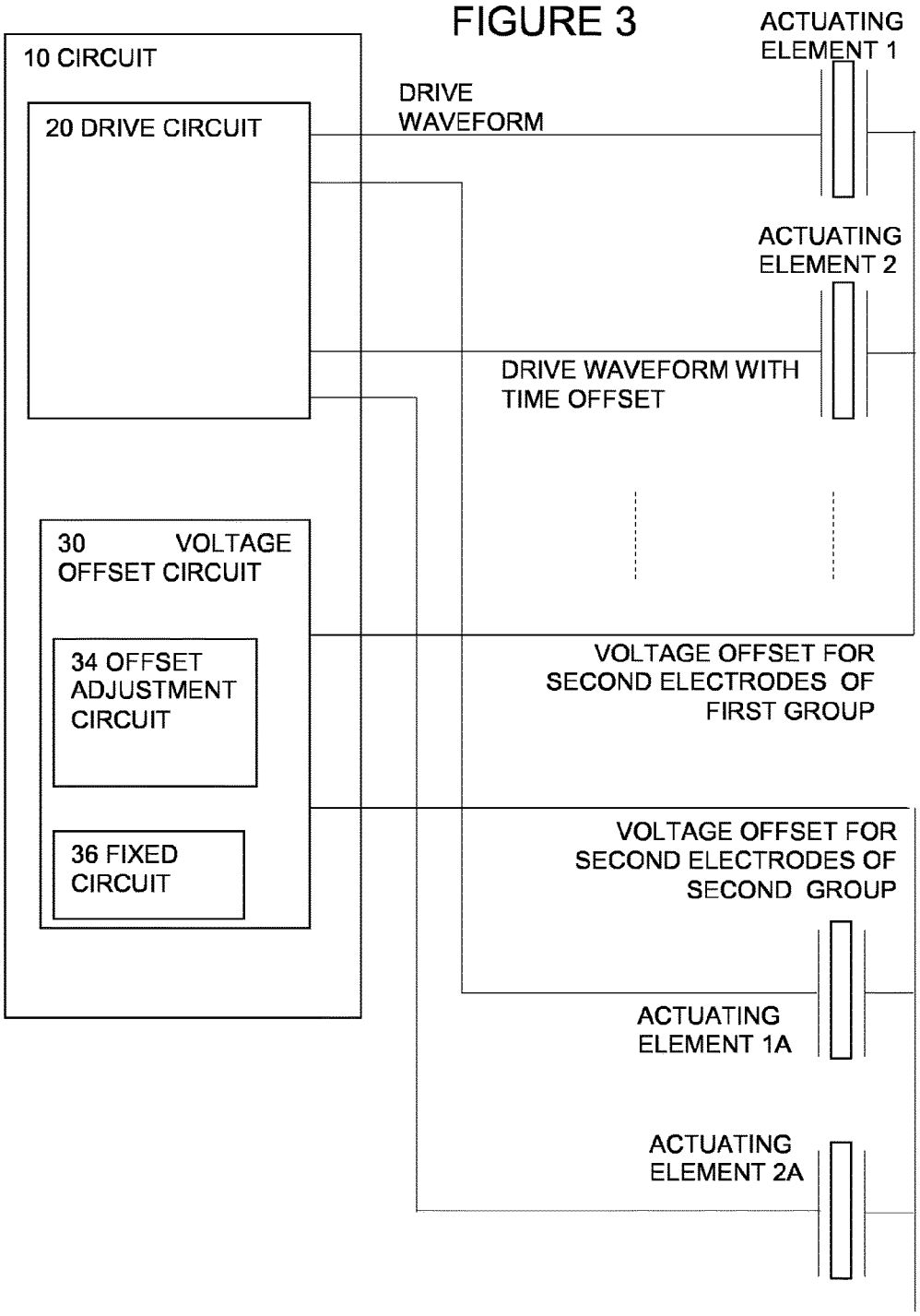

FIG. 3 shows a schematic view of an embodiment similar to that of FIG. 2 and corresponding reference numerals have been used as appropriate. In this Figure the voltage offset circuit 30 is arranged to have an offset adjustment circuit 34 and a fixed circuit 36. In some cases there may be only one of these parts. The fixed circuit 36 can provide a static voltage compensation amount which may be set at the time of manufacture of the printhead, to compensate for static non-uniformities as described above. The offset adjustment circuit 34 can provide variable voltage offsets for compensating for dynamic or changing non-uniformities as described above. If both parts are provided, they can provide a combined output for example by providing an adder to add their outputs. Alternatively, the combined output may be achieved by using the fixed circuit to bias the input of the offset adjustment circuit, for example. There may be one or more of these fixed and adjustment circuits provided for each group of the actuating elements.

Figure 4:
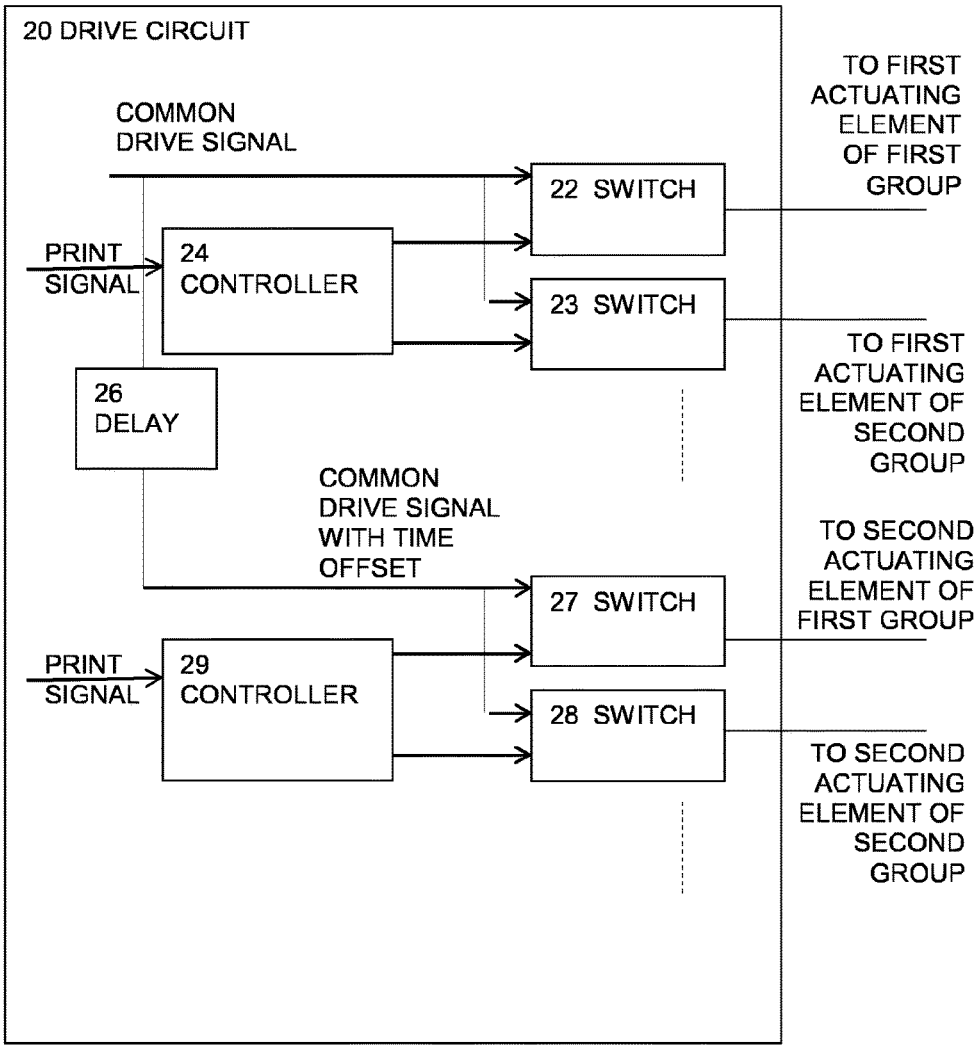
FIG. 4 shows a schematic view of a drive circuit for use in the embodiment of FIG. 1 or other embodiments.

FIG. 4 shows a schematic view of a drive circuit 20 for use in the above described embodiments or in other embodiments. This represents a "cold switch" type drive circuit, though other types are possible. A common drive signal is provided, either generated externally (e.g. by a controller) or on the printhead (e.g. on a printed circuit board (PCB) provided thereon), and is shared by all the actuating elements.

Individual switches 22, 23, 27, 28 are provided to selectively switch the common drive signal onto each actuating element, typically on a pixel by pixel basis. The switches are controlled by a controller 24, 29 fed by a print signal such as a line scanning serial signal. A delay element 26 is provided to produce a version of the common drive signal with a time offset.

An alternative implementation would be to provide separate waveform generation circuits to generate two separate common waveforms with a temporal offset between them.

As shown in the present example, a drive waveform to the first actuating element of the first group of actuating elements is fed from the common drive signal via switch 22. A drive waveform to the first actuating element of the second group of actuating elements is fed from the common drive signal via switch 23. A drive waveform to the second actuating element of the first group of actuating elements is fed from the common drive signal via delay 26 and switch 27. A drive waveform to the second actuating element of the second group of actuating elements is fed from the common drive signal via delay 26 and switch 27. In each case, timing of the switching is controlled by controllers 24, 27, according to whether a dot is required at the locations corresponding to the actuating elements. If the printer is a line printer with a part to move the media being printed for each line, then the controllers handle the synchronisation with the movement of the media.

Figure 5:
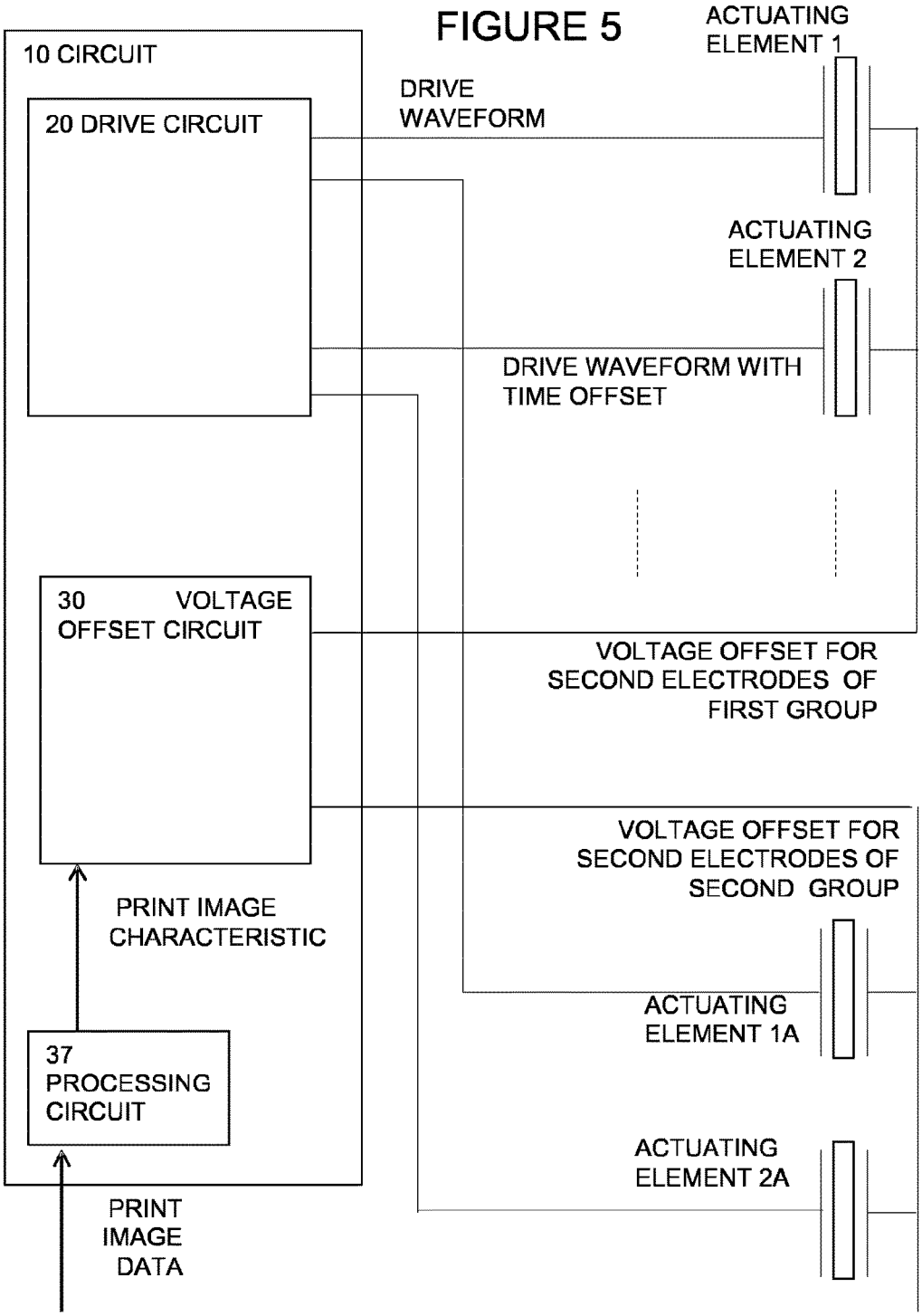
FIG. 5 shows a schematic view of a circuit according to other embodiment.

FIG. 5 shows a schematic view of an embodiment similar to that of FIG. 1 and corresponding reference numerals have been used as appropriate. In FIG. 5 the voltage offset circuit 30 is arranged to use a print image characteristic derived from print image data for generating the voltage offset. The voltage offset can be used either for compensating for non-uniformities caused by the print image characteristic or to provide some low resolution enhanced print effects based on the print image characteristic. In either case, the print image data may be sent to a processing circuit 37 which derives the print image characteristic which is to be compensated or printed. This is used by the voltage offset circuit to generate the appropriate voltage offsets for the different groups of actuating elements.

The print image characteristic can be, for example, a total number of active pixels in the image (e.g. the number of actuating elements firing at substantially the same time) or the current line of the image, which may influence the loading on the power supply and amplifier circuitry and therefore cause non-uniformity in print output, or result in thermal, electrical, fluidic and/or mechanical effects (e.g. crosstalk) at the printhead, thereby also causing a non-uniformity in the print output. The print image characteristic may include more complex values, for example values based on spatial profiles in different directions in the image, or profiles of temporal changes, or combinations of these. The temporal profile may represent how active a given actuating element or actuating elements have been recently, since this can affect the temperature and other characteristics of the fluid, the actuating element, the printhead and so on, and thus the amount of compensation needed.

Figure 6:
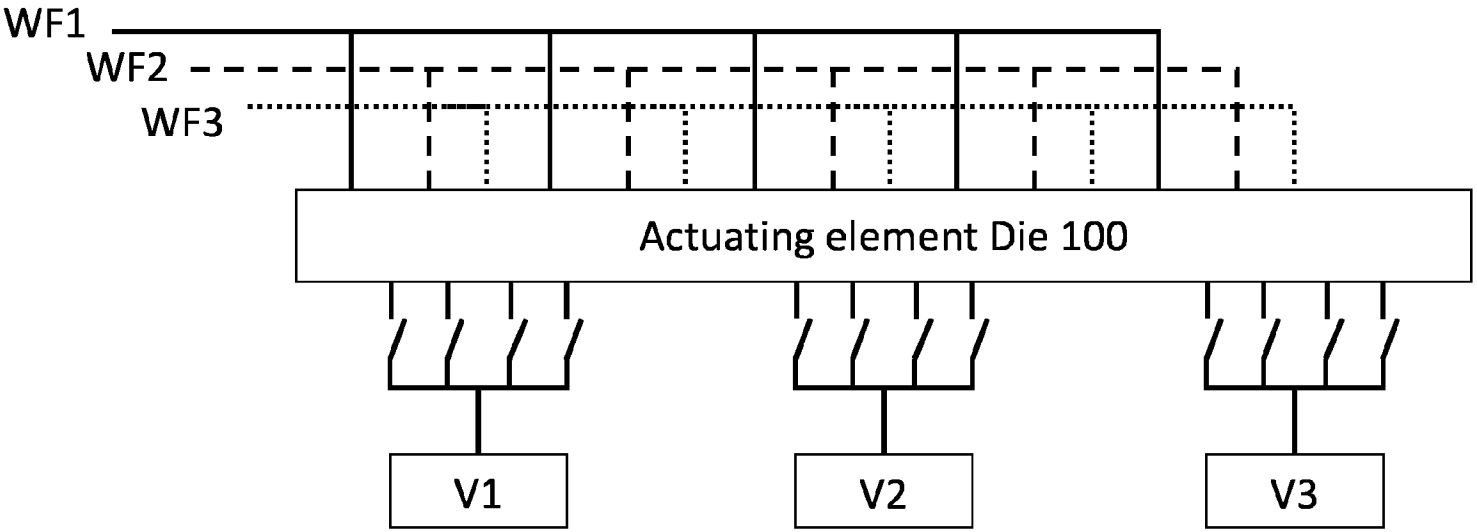
FIG. 6 shows a schematic view of an arrangement of groups of actuating elements according to an embodiment.

FIG. 6 shows a schematic view of an arrangement of groups of actuating elements. The actuating elements are located on an actuating element die 100.

In the present example, the first electrodes of the actuating elements are coupled in three sets to three interleaved drive waveforms, WF1, WF2 and WF3. As will be appreciated, there can be any number of sets. The second electrodes are coupled in three groups to three voltage sources, which provide voltage offsets V1, V2 and V3 respectively. As will be appreciated, there can be any number of groups.

Whilst schematically depicted as such, the groups are not limited to consisting of adjacent actuating elements, and need not be provided in a linear arrangement, but could be two-dimensional patches or clusters, or other patterns, if there is a two dimensional array of actuating elements for example. The arrangement of groups may be determined by the wiring or may be made configurable by providing suitable switches.

Figure 7:
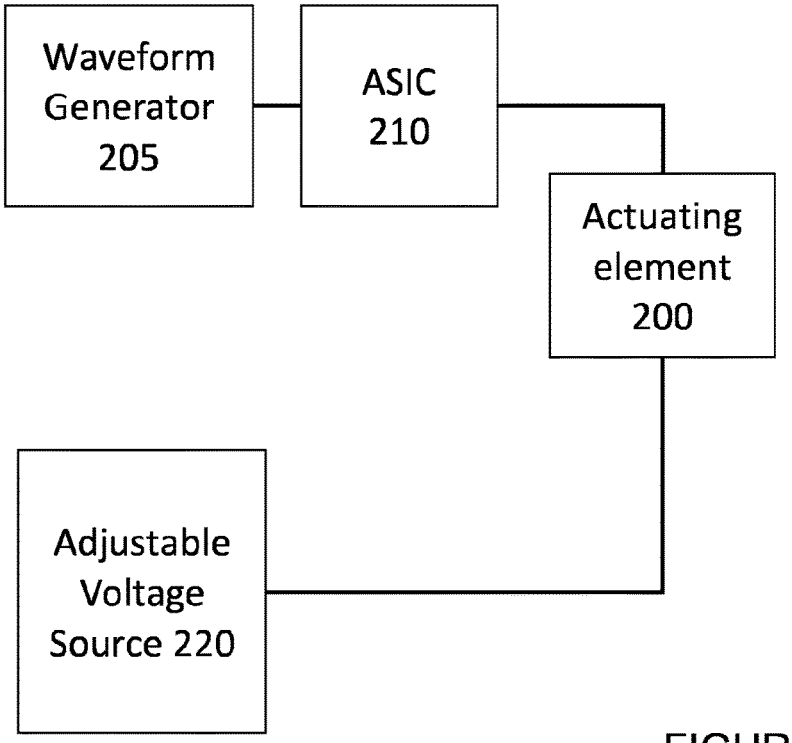
FIGS. 7, 8 and 9 show schematic views of other embodiments.

FIG. 7 shows a schematic view of another embodiment. In this case a waveform generator 205 feeds an ASIC 210 with a common drive signal. The ASIC provides individual switches and controllers for switching of the common drive signal onto each of the first electrodes of the respective actuating elements (one of which is depicted in FIG. 7 as actuating element 200) to actuate the actuating elements. The second electrodes of the respective actuating elements are coupled to adjustable voltage source 220 which provides the voltage offsets for the respective groups of the actuating elements.

Figure 8:
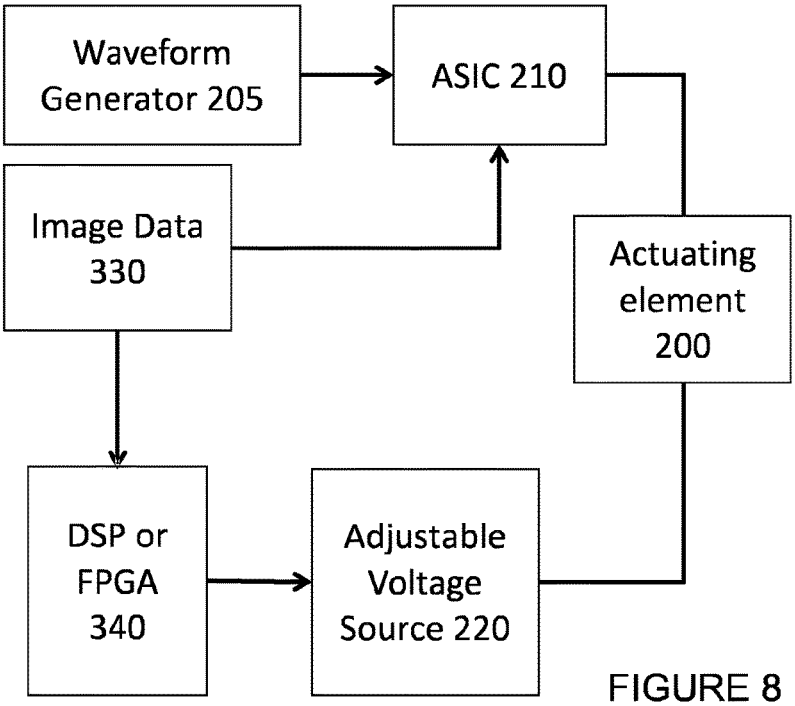

FIG. 8 shows a schematic view of another embodiment similar to that of FIG. 7 and corresponding reference numerals have been used as appropriate. In this case image data 330 for printing is fed to the ASIC 210 to control the switching, and is also fed to a processing circuit 340, in the form of, for example, a DSP (digital signal processor) or FPGA, to process the image to provide a print image characteristic to the adjustable voltage source 220. This embodiment can be used in a similar way to that of FIG. 5, to provide image-based compensation for non-uniformities which are dependent on the image being printed. Also it can be used to provide some low resolution filtering of the printed image, if desired, as described above.

Figure 9:
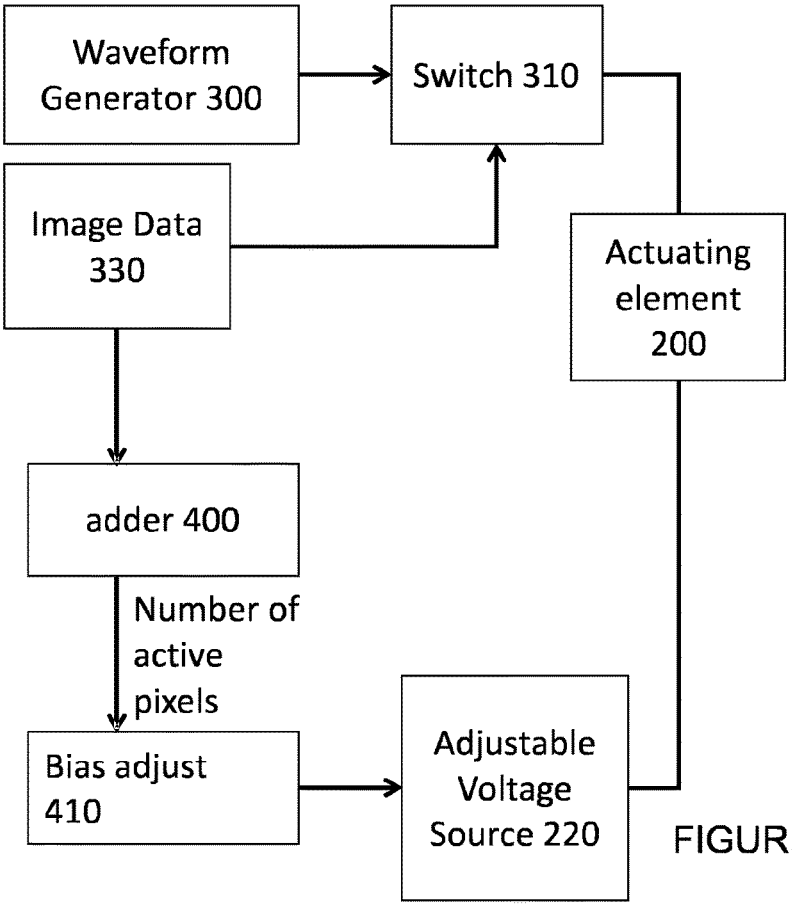

FIG. 9 shows a schematic view of another embodiment similar to that of FIG. 8 and corresponding reference numerals have been used as appropriate. In this case a simplified more cost effective form of image processing circuitry is used. Image data 330 for printing is fed to an adder 400 which can add up the number of active pixels in the image. This produces a value which may be used by a bias adjust circuit 410 to produce a bias signal, such as a digital value or an analog bias voltage for example. This is fed to the adjustable voltage source 220 where it may be added to a fixed voltage offset for each group of actuating elements for example.

Figure 10:
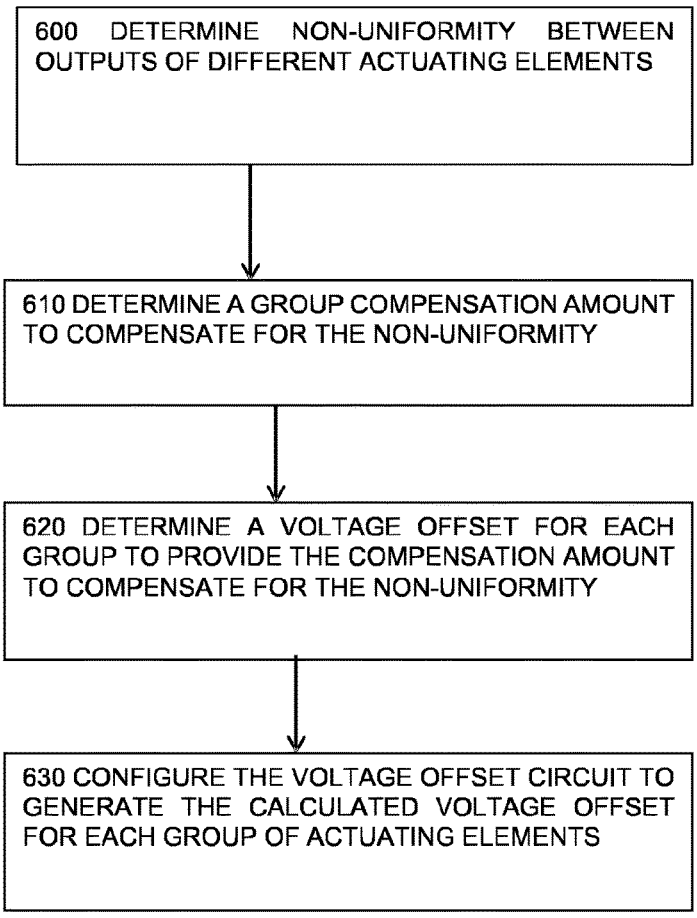
FIG. 10 shows steps in a method according to an embodiment.

FIG. 10 shows steps in a method of calibrating and adjusting the voltage offset according to an embodiment.

At step 600 there is a step of determining a non-uniformity between outputs of different actuating elements. This can encompass measuring print output or circuit output values, or looking up or interpolating or calculating for example.

At step 610 a group compensation amount is determined, to reduce or minimise the non-uniformity, based on the preceding step. Again this can involve a calculation or a look up operation for example.

At step 620 a voltage offset is determined for each group to provide the required compensation. This can involve looking up or measuring how much voltage offset is needed to provide sufficient alteration to the voltage difference across the electrodes. The voltage offset may be controlled in some cases to provide not just an offset level, but an offset shape to alter not just the amplitude (e.g. peak amplitude) but also the shape of the drive waveform.

At step 630 the voltage offset circuit is configured to generate the calculated voltage offsets for each of the respective groups. This may encompass setting resistor or other component values, or setting digital values stored in NV (non-volatile) memory, or stored externally, or other steps.

These steps may be carried out during manufacture of the printhead or during configuration of a printer having the printhead to provide compensation for manufacturing-type non-uniformities. In other cases the steps may be carried out periodically during operation of the printer to update the values or to dynamically adjust to changing conditions such as temperature.

To verify the required precision of control to achieve the desired voltage offset compensation required, the following steps can be carried out for each group of actuating elements.

- A defined pulse is applied to the first electrode of the actuating element.
- The second electrode has the voltage varied to mimic the range of possible voltage offsets.

The velocity of the resulting droplet will be measured to characterise the behaviour of the actuating element with varying voltage offsets.

Figure 11:
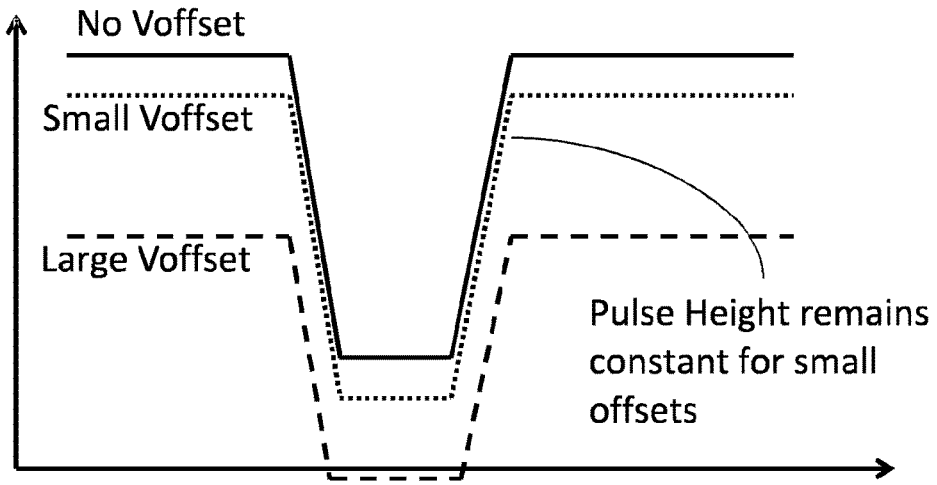
FIG. 11 shows a time chart of drive waveforms with voltage offsets.

FIG. 11 shows a time chart of a drive waveform showing one downgoing pulse for causing one droplet of fluid to be ejected from a typical piezoelectric actuating element for example. Other shapes of waveform can be used, with different rise or fall times or comprising multiple peaks for example. A solid line shows the pulse for no voltage offset. A dotted line shows the pulse for a small voltage offset, in which case the pulse height remains constant. The dashed line shows the pulse for a larger voltage offset. Furthermore, the pulse height may be reduced for large offsets, e.g. by providing a diode on the output of the ASIC to clamp the voltage to below zero.

Therefore, by adjusting the voltage offset applied to an actuating element it is possible to change the characteristics of droplets generated by the actuating element, even if a substantially identical drive waveform is applied to the actuating element. Such effects may include variations in velocity or in volume of the generated droplet. As such, it is possible to adjust and control the landing position of such a droplet on a print medium by suitably adjusting the voltage offset. Furthermore, by applying such functionality across an array of actuating elements the velocities of the resulting respective droplets may be matched, which provides for synchronisation of droplets on a print medium.

Figure 13:
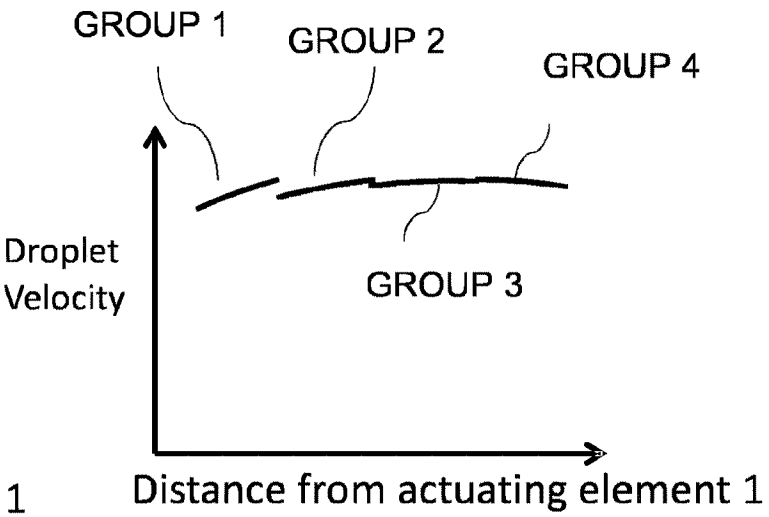
FIGS. 12 and 13 show graphs of variation in droplet velocity along a linear array of actuating elements without and with compensation according to an embodiment.
Figure 12:
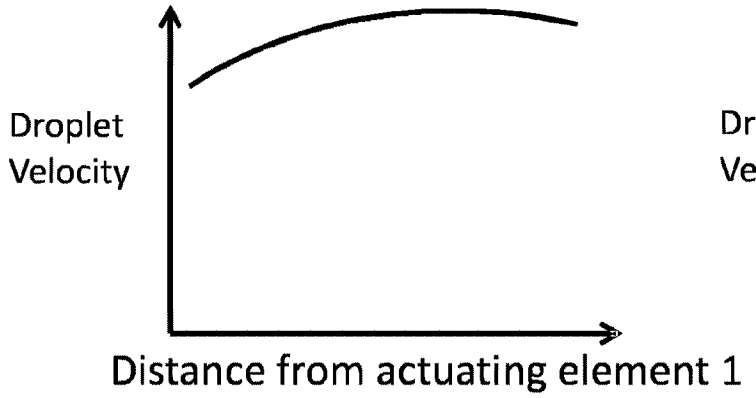

FIG. 12 shows a graph to demonstrate an example of non-uniformity, whilst FIG. 13 shows a graph to demonstrate how such non-uniformity is compensated for.

FIG. 12 illustratively shows variation in droplet velocity due to non-uniformities along a linear array of actuating elements from a first actuating element, whereby droplet velocity is lower at the near end and higher towards the far end of the graph.

FIG. 13 illustratively shows variation of droplet velocity due to non-uniformities along the linear array, whereby a voltage offset is applied to different groups to compensate for the non-uniformities.

In FIG. 13, a first group of actuating elements (Group 1) has a drive waveform and no voltage offset applied thereto. A second group of actuating elements (Group 2) has a substantially identical drive waveform and a voltage offset applied thereto, so as to vary the response of the actuating elements in Group 2, as explained above. The remaining groups of actuating elements (Groups 3 and 4) are also provided with substantially identical drive waveforms and different voltage offsets in order to vary the responses of the actuating elements of the respective groups as desired.

The overall effect of providing different voltage offsets to the groups is to change the characteristics of droplets generated by the actuating elements of each group e.g. by reducing variations in droplet velocity between each of the different groups.

Group boundaries may be chosen to minimise for uncompensated effects (e.g. to minimise variations in droplet velocities between different groups) by, for example, having groups of different sizes e.g. large groups where there is a relatively small gradient (e.g. variations in drop velocity), and smaller groups where the gradient is larger.

FIG. 13 shows a typical effect when trying to compensate for spatial variations along a linear array of actuating elements. The groups of actuating elements do not completely compensate such variation. Residual unwanted differences in print output between different actuating elements within a group may remain as shown in FIG. 13.

These residual differences can either be tolerated or may be compensated in other ways such as by trimming per actuating element if desired. Notably, the range of such residual differences and therefore the possible range of per actuating element trimming can be much reduced, which may reduce costs or improve performance. If desired, the uncompensated spatial variations, and the residual variations after compensation can be predicted by modelling using for example a capacitance nonlinearity equation for a given actuating element together with information about the applied compensation voltage. Measurements can be made of the resulting actuating element performance, and the errors between desired or ideal performance, modelled performance and actual performance can be determined. The capacitance equation can be a close match of the performance of the actuating element with applied voltage, and as such it is a good proxy for the nonlinear performance of the actuating element.

Whilst the embodiments discussed above generally relate to compensating for non-uniformities in actuating elements (or sets/groups thereof) across an array, it will be understood that such techniques may be used to compensate for non-uniformities between actuating elements (or sets/groups thereof) located on different arrays and/or between actuating element dies. Furthermore, such techniques may be used to compensate for non-uniformities between actuating elements (or sets/groups thereof) located on different printheads.

FIG. 14*a* illustratively shows a wafer 500, e.g. a silicon wafer, comprising a plurality of actuating element dies 501, each actuating element die 501 comprising one or more arrays 502 of actuating elements (not shown in detail in FIG. 14*a*) provided thereon.

In the illustrative example of FIG. 14*a*, the actuating elements are provided in linear arrays on the actuating element dies 501, whereby the actuating element dies 501 may have any number of linear arrays provided thereon. It will be noted that only a selection of the linear arrays are illustratively shown in FIG. 14*a*.

FIGS. 14*b*-14*e* illustratively show graphs demonstrating variation in performance along a selection of the linear arrays (502*a*-502*d*).

The performance of the actuating elements in the different arrays 502, of the same or different wafers, may differ from one another due to manufacturing-type variations. Such manufacturing-type variations may also be evident across wafers from different batches. As discussed previously, the variation in performance may for example result in the different actuating elements generating droplets of different droplet velocities.

As can be seen from the respective graphs, the performance of the actuating elements varies along each of the arrays, and, furthermore, the performance of the respective arrays also differs from one another.

FIG. 15*a* illustratively shows the actuating element die 501 of FIG. 14*a* in greater detail, and corresponding reference numerals have been used as appropriate.

Whilst the actuating element die 501 of FIG. 15*a* is depicted as having four linear arrays of actuating elements 510, any number of arrays may be provided. Furthermore, as above, the actuating elements 510 may be provided in non-linear arrays of neighbouring actuating elements, or 2-dimensional rectangles or other patterns of neighbouring actuating elements, or any pattern or arrangement, regular or irregular or random, of neighbouring or non-neighbouring actuating elements.

A drive circuit 20 is arranged to provide a drive waveform to first electrodes of actuating elements 510. In FIG. 15*a*, substantially identical waveforms are sent to the first electrodes of all actuating elements 510 on the actuating element die 501. A temporal offset may be provided between the waveforms to reduce electrical and/or fluidic crosstalk between different sets of actuating elements.

A voltage offset circuit 30 is arranged to provide voltage offset values to second electrodes of different groups of actuating elements, whereby each group has the same offset value applied thereto.

In FIG. 15*a*, each linear array 502 comprises a group of actuating elements, whereby the voltage offset circuit 30 provide the voltage offset values (V1-V4) to the respective groups, such that the second electrodes of one or more of the groups may be biased relative to second electrodes of the other groups, so as to compensate for any variations in performance between the groups e.g. caused by non-uniform outputs from the actuating elements of the groups.

FIGS. 15*b* and 15*c* are graphs illustratively showing the average droplet velocities across the four different arrays 502, whereby FIG. 15*b* shows the average droplet velocity when the voltage offset values (V1-V4) are substantially identical (e.g. ~0V), whilst FIG. 15*c* shows the average droplet velocity when the voltage offset values (V1-V4) are individually adjusted to take account of variations in performance of the actuating elements across the arrays 502, for example due to non-uniformities as discussed previously.

In the present embodiment, the voltage offset values (V1-V4) are adjusted to vary the performance of the respective arrays, so as to provide a substantially identical average droplet velocity for the four different arrays.

FIG. 16 illustratively shows a portion of actuating element die 501 according to an embodiment. Reference numerals corresponding to elements described in FIGS. 14*a* and 15*a* have been used as appropriate.

As before, a temporal offset (shown as to in FIG. 16) may be provided between waveforms applied to different sets of actuating elements to provide for reduced electrical and/or fluidic crosstalk between neighbouring actuating elements in an array 502.

Additionally or alternatively a voltage offset may be applied to different groups of actuating elements 510, such that the second electrodes of one or more of the groups may be biased relative to second electrodes of the other groups, so as to compensate for any variations in performance between the groups e.g. caused by non-uniform outputs from the actuating elements of the groups.

FIG. 16 illustratively shows how interleaved waveforms and different voltage offsets may be provided to the respective first and second electrodes of actuating elements 510 arranged in two linear arrays extending in a length direction of the actuating element die 501.

Whilst the actuating elements of the same array are arranged in a linear fashion with respect to each other, neighbouring actuating elements 510 of adjacent rows are arranged offset with respect to each in the width direction of the actuating element die 501.

As before, the actuating elements 510 are not limited to being arranged in linear arrays, nor are actuating elements of adjacent rows limited to being arranged offset with respect to each other.

In the present example, adjacent actuating elements 510 of the same array are designated as being in different sets (see A&C and B&D), whereby first electrodes of the actuating elements of set A are arranged to receive a drive waveform from a drive circuit 20, whilst first electrodes of the actuating elements of set C are arranged to receive the same drive waveform as set A, but having a temporal offset (to). Similarly, the first electrodes of the actuating elements of set B are arranged to receive a drive waveform from the drive circuit 20, whilst the first electrodes of actuating elements of set D are arranged to receive the same waveform as set B but with a temporal offset.

Providing the same interleaved waveform to different sets of actuating elements (A, B, C and D) provides for reduced fluidic and/or electrical crosstalk between adjacent actuating elements in the same array.

In addition to providing for reduced electrical and/or fluidic crosstalk, the configuration also provides for a reduction in the complexity of the electronic circuitry in comparison to known printheads.

In the present example, adjacent actuating elements 510 of the same array ((A&C) and (B&D)) are designated as being in the same group, whereby, second electrodes of the respective actuating elements of group (A&C) are arranged to have the same voltage offset (V1) as each other, whilst second electrodes of the respective actuating elements of group (B&D) are also arranged to have the same voltage offset (V2) as each other. Therefore the second electrodes of group (A&C) may be biased relative to second electrodes of group (B&D). The respective voltage offsets (V1 and V2) may be set and/or adjusted by the voltage offset circuit 30.

The configuration described in FIG. 16 allows for the performance of each individual array to be adjusted to compensate for any variations in performance between the groups, whereby, for example, the average droplet velocity/volume of each group may be adjusted by the voltage offset circuit 30.

In the present example, the second electrodes of alternate actuating elements of each array are connected to individual electrical connections 516 provided on the actuating element die 501. The individual electrical connections 516 are then combined as a single electrical connection 517 (e.g. a flexible printed cable) in electrical communication with voltage offset circuit 30. The electrical connection 517 is provided, for example, off-die, whereby the resistance of the electrical connection 517 can be lower than that of the electrical connections 516, the lower resistance contributing to reduced electrical crosstalk. The lower resistance may be achieved, for example, by increasing the thickness of the electrical connection 517 off-die in comparison to the electrical connections 516 provided on the actuating element die 501. In alternative embodiments, the electrical connections are maintained as discrete electrical connections back to the voltage offset circuit 30.

Different groups of actuating elements 510 other than those depicted in FIG. 16 may be designated. As an illustrative example, one group may comprise the actuating elements of set A, another group may comprise the actuating elements of set B, another group may comprise the actuating elements of set C, and another group may comprise the actuating elements of set D.

As a further alternative illustrative example, one group may comprise the actuating elements of sets A&D, whilst another group may comprise the actuating elements of sets B&C. It will be understood that any suitable configuration of groups may be controlled by the voltage offset circuit.

FIG. 17*a* illustratively shows a printhead 520 (denoted generally by the broken lines) comprising a plurality of actuating element dies 501*a*-501*n* according to a further embodiment, whilst FIGS. 17*b* and 17*b* show graphs of variation in average droplet velocity from different actuating element dies 501*a*-501*n* without and with compensation.

Reference numerals corresponding to elements described previously are used as appropriate.

The printhead 520 may comprise any number (n) of actuating element dies. In the present example, each actuating element die 501*a*-501*n* comprises a plurality of actuating elements 510 provided in arrays thereon.

For the present embodiment, actuating elements 510 on the same actuating element dies 501*a*-501*n* are part of the same set, whereby the drive circuit 20 is arranged to provide a common drive waveform to the first electrodes of each set. In embodiments, a common waveform may be interleaved and provided to respective sets as previously described.

Furthermore, the actuating elements 510 of each actuating element die 501*a*-501*n* are depicted as being in the same group, and, therefore, by varying the voltage offsets (V1-Vn) provided to the respective groups, the voltage offset circuit 30 can control the performance of the respective actuating element dies 501*a*-501*n* to compensate for non-uniformities e.g. adjust average velocity/volume of droplets generated therefrom.

In alternative embodiments, each of the actuating element dies 501*a*-501*n* may comprise a number of different groups, e.g. whereby each array of an actuating element die comprises a different group, or whereby a group comprises a selection of actuating elements 510 from one or more of the actuating element dies 501*b*-501*n*.

Similarly, actuating elements 510 on different actuating element dies 501*a*-501*n* may be designated as being in the same set.

FIG. 17*b* illustratively shows average droplet velocity for the different actuating element dies 501*a*-501*n* without compensation for the different groups, whereby the average droplet velocity is different for each actuating element die 501*a*-501*n*. As above, such differences in droplet velocity may affect print quality.

FIG. 17*c* illustratively shows average droplet velocity across the different actuating element dies 501*a*-501*n* of the printhead 520 when a voltage offset is applied to the different groups.

In the present example, the voltage offset provides a substantially identical average droplet velocity for the different actuating element dies 501*a*-501*n*, which may provide improved print quality across the printhead 520.

As above, the overall effect of providing different voltage offsets to the groups (i.e. the different actuating element dies 501*a*-501*n* in FIG. 17*a*) is to change the characteristics of droplets generated by the actuating elements of the respective group, for example, in this case, by reducing variations in droplet velocity across the different groups.

In further embodiments, the functionality may be extended to control the performance of different printheads, each printhead having one or more sets/groups of actuating element dies.

The printhead embodiments described above can be used in various types of printer. Two notable types of printer are:

a) a page-wide printer (where printheads in a single pass cover the entire width of the print medium, with the print medium (tiles, paper, fabric, or other example, in one piece or multiple pieces for example) passing in the direction of printing underneath the printheads), and b) a scanning printer (where one or more printheads pass back and forth on a printbar (or more than one printbar, for example arranged one behind the other in the direction of motion of the print medium), perpendicular to the direction of movement of the print medium, whilst the print medium advances in increments under the printheads, and being stationary whilst the printhead scans across).

There can be large numbers of printheads moving back and forth in this type of arrangement, for example 16 or 32, or other numbers.

In both scenarios, the printheads may be mounted on printbar(s) to print several different fluids, such as but not limited to, different colours, primers, fixatives, functional fluids or other special fluids or materials. Different fluids may be ejected from the same printhead, or separate printbars may be provided for each fluid or each colour for example.

Other types of printer can include 3D printers for printing fluids comprising polymer, metal, ceramic particles or other materials in successive layers to create solid objects, or to build up layers of an ink that has special properties, for example to build up conducting layers on a substrate for printing electronic circuits and the like. Post-processing operations can be provided to cause conductive particles to adhere to the pattern to form such circuits.

FIG. 18 shows a schematic view of a printer 440 coupled to a source of data for printing, such as a host PC 460. The printhead of FIG. 1 corresponds to printhead circuit board 180 having one or more actuating element 110 and a drive circuit 20. Printer circuitry 170, is coupled to the printhead circuit board, and coupled to a processor 430 for interfacing with the host, and for synchronizing drive of actuating elements and location of the print media. This processor is coupled to receive data from the host, and is coupled to the printhead circuit board to provide synchronizing signals at least. The printer also has a fluid supply system 420 coupled to the printhead, and a media transport mechanism and control part 400, for locating the print medium 410 relative to the printhead. This can include any mechanism for moving the printhead, such as a movable printbar. Again this part can be coupled to the processor to pass synchronizing signals and for example position sensing information. A power supply 450 is also shown.

The printer can have a number (for example 16 or 32 or other numbers) of inkjet printheads attached to a rigid frame, commonly known as a print bar. The media transport mechanism can move the print medium beneath or adjacent the print bar. A variety of print media may be suitable for use with the apparatus, such as paper sheets, boxes and other packaging, or ceramic tiles. Further, the print media need not be provided as discrete articles, but may be provided as a continuous web that may be divided into separate articles following the printing process.

The printheads may each provide an array of actuating chambers having respective actuating elements for droplet ejection. The actuating elements may be spaced evenly in a linear array. The printheads can be positioned such that the actuating element arrays are parallel to the width of the substrate and also such that the actuating element arrays overlap in the direction of the width of the substrate. Further, the actuating element arrays may overlap such that the printheads together provide an array of actuating elements that are evenly spaced in the width direction (though groups within this array, corresponding to the individual printheads, can be offset perpendicular to the width direction). This may allow the entire width of the substrate to be addressed by the printheads in a single printing pass.

The printer can have circuitry for processing and supplying image data to the printheads. The input from a host PC for example may be a complete image made up of an array of pixels, with each pixel having a tone value selected from a number of tone levels, for example from 0 to 255. In the case of a colour image there may be a number of tone values associated with each pixel: one for each colour. For example, in the case of CMYK printing there will therefore be four values associated with each pixel, with tone levels 0 to 255 being available for each of the colours.

Typically, the printheads will not be able to reproduce the same number of tone values for each printed pixel as for the image data pixels. For example, even fairly advanced grey-scale printers (which term refers to printers able to print dots of variable size, rather than implying an inability to print colour images) will only be capable of producing 8 tone levels per printed pixel. The printer may therefore convert the image data for the original image to a format suitable for printing, for example, using a half-toning or screening algorithm. As part of the same or a separate process, it may also divide the image data into individual portions corresponding to the portions to be printed by the respective printheads. These packets of print data may then be sent to the printheads.

The fluid supply system can provide fluid to each of the printheads, for example by means of conduits attached to the rear of each printhead. In some cases, two conduits may be attached to each printhead so that in use a flow of fluid through the printhead may be set up, with one conduit supplying fluid to the printhead and the other conduit drawing fluid away from the printhead.

In addition to being operable to advance the print articles beneath the print bar, the media transport mechanism may include a product detection sensor (not shown), which ascertains whether the medium is present and, if so, may determine its location. The sensor may utilise any suitable detection technology, such as magnetic, infra-red, or optical detection in order to ascertain the presence and location of the substrate.

The print-medium transport mechanism may further include an encoder (also not shown), such as a rotary or shaft encoder, which senses the movement of the print-medium transport mechanism, and thus the substrate itself. The encoder may operate by producing a pulse signal indicating the movement of the substrate by each millimeter. The Product Detect and Encoder signals generated by these sensors may therefore indicate to the printheads the start of the substrate and the relative motion between the printheads and the substrate.

The processor can be used for overall control of the printer systems. This may therefore co-ordinate the actions of each subsystem within the printer so as to ensure its proper functioning. It may, for example signal the fluid supply system to enter a start-up mode in order to prepare for the initiation of a printing operation and once it has received a signal from the fluid supply system that the start-up process has been completed it may signal the other systems within the printer, such as the data transfer system and the substrate transport system, to carry out tasks so as to begin the printing operation.

Other embodiments and variations can be envisaged within the scope of the claims.

The invention claimed is:

1. A circuit for driving first and second groups of actuating elements, each group having a plurality of actuating elements for ejection of droplets from a printhead, the circuit comprising:

a drive circuit configured to provide a drive waveform to first electrodes of the plurality of actuating elements of the first and second groups; and a voltage offset circuit configured to provide a voltage offset to the second electrodes of the plurality of actuating elements of the first or second groups to bias the second electrodes of the plurality of actuating elements of the first and second groups relative to each other.

2. The circuit of claim 1, wherein the drive circuit is configured to provide a time offset between the drive waveform applied to different sets of actuating elements so as to temporally offset corresponding transitions of the respective drive waveforms.

3. The circuit of claim 1, the voltage offset being suitable to compensate for a non-uniformity in droplet ejection between the first and second groups of actuating elements.

4. The circuit of claim 1, having an offset adjustment circuit having a fixed circuit to generate a fixed component of the voltage offset and a voltage offset circuit configured to adjust the voltage offset being arranged to combine the fixed component with an adjustable voltage offset provided by the offset adjustment circuit.

5. The circuit of claim 1, the drive circuit being configured to provide at least two common drive waveforms, offset in time from each other, each for driving a set of actuating elements, and the drive circuit comprising one or more switches, each switch being configured for selectively coupling one of the common drive waveforms to a respective group, the drive circuit having a controller for controlling the switches according to a print signal.

6. The circuit of claim 1, having a processing circuit configured to generate a print image characteristic, and the voltage offset circuit being arranged to generate the voltage offset according to the print image characteristic.

7. The circuit of claim 1, wherein the drive circuit is configured to provide a time offset between the drive waveform applied to different sets of actuating elements so as to temporally offset corresponding transitions of the respective drive waveforms, and wherein the first group comprises actuating elements of a first set of the different sets, and the second group comprises actuating elements of a second set of the different sets.

8. The circuit of claim 1, wherein the first group comprises actuating elements of a first set and of a second set, and wherein the second group comprises actuating elements of the first set and second set.

9. A printhead comprising one or more actuating element dies, each actuating element die having a plurality of actuating elements for the ejection of droplets provided in one or more arrays thereon, wherein first electrodes of the actuating elements are arranged to be coupled to a drive circuit for driving a first group of the plurality actuating elements and a second group of the plurality of actuating elements, the drive circuit configured to provide a drive waveform to first electrodes of the plurality of actuating elements of the first and second groups; and wherein second electrodes of the actuating elements are arranged to be coupled to a voltage offset circuit, the voltage offset circuit configured to provide a voltage offset to the second electrodes of the plurality of actuating elements of the first or second groups to bias the second electrodes of the plurality of actuating elements of the first and second groups relative to each other.

10. The printhead according to claim 9, wherein each of the one or more actuating element dies comprise one or more arrays having the at least one of the first or second group of actuating elements.

11. The printhead according to claim 10, wherein each of the one or more arrays comprise actuating elements from different groups.

12. The printhead according to claim 9, wherein each of the one or more dies comprise actuating elements are configured to be provided by the drive circuit with a time offset between the drive waveform applied to different sets of actuating elements so as to temporally offset corresponding transitions of the respective drive waveforms.

13. The printhead according to claim 9, wherein the actuating elements of the first and second group are arranged to receive from the drive circuit a first and second common drive waveform, the common drive waveforms offset in time from each other, each for driving a set of actuating elements.

14. The printhead according to claim 13, wherein the actuating elements of the first and second group each comprise a first and second set of the sets of actuating elements to receive a first and second waveform offset.

15. A printer having a printhead, a drive circuit and a voltage offset circuit, the printhead comprising one or more actuating element dies, each actuating element die having a plurality of actuating elements for the ejection of droplets provided in one or more arrays thereon, wherein first electrodes of the actuating elements are coupled to the drive circuit for driving first and second groups of actuating elements, each group having a plurality of actuating elements for ejection of droplets from a printhead, the drive circuit configured to provide a drive waveform to first electrodes of the plurality of actuating elements of the first and second groups; and wherein second electrodes of the actuating elements are coupled to the voltage offset circuit, the voltage offset circuit configured to provide a voltage offset to the second electrodes of the plurality of actuating elements of the first or second groups to bias the second electrodes of the plurality of actuating elements of the first and second groups relative to each other.

16. The printer according to claim 15, wherein each of the one or more actuating element dies of the printhead each comprise one or more arrays having at least one or more groups of different actuating elements.

17. The printer according to claim 15, further comprising an offset adjustment circuit having a fixed circuit to generate a fixed component of the voltage offset and a voltage offset circuit configured to adjust the voltage offset being arranged to combine the fixed component with an adjustable voltage offset provided by the offset adjustment circuit.

18. The printer according to claim 15, the drive circuit being configured to provide at least two common drive waveforms, offset in time from each other, each for driving a set of actuating elements, and the drive circuit comprising one or more switches, each switch being configured for selectively coupling one of the common drive waveforms to a respective group, the drive circuit having a controller for controlling the switches according to a print signal.

19. A method of configuring a printhead, the method comprising:

determining a non-uniformity in performance between first and second groups of actuating elements of the printhead;

determining a group compensation amount for the first group of the actuating elements to compensate for the non-uniformity;

determining a voltage offset to provide the group compensation amount;

configuring a voltage offset circuit to generate the voltage offset;

providing a drive waveform to first electrodes of the first and second groups; and providing the voltage offset to second electrodes of the first group and/or the second group to bias the second electrodes of the first and second groups relative to each other.

* * * * *